US005787389A

United States Patent [19]

Taumi et al.

[11] Patent Number: 5,787,389

[45] Date of Patent: Jul. 28, 1998

[54] SPEECH ENCODER WITH FEATURES EXTRACTED FROM CURRENT AND PREVIOUS FRAMES

[75] Inventors: Shin-Ichi Taumi; Kazunori Ozawa, both of Tokyo, Japan

[73] Assignee: NEC Corporation, Tokyo, Japan

[21] Appl. No.: 588,005

[22] Filed: Jan. 17, 1996

[30] Foreign Application Priority Data

Jan. 17, 1995 [JP] Japan ..... 7-004921
Jan. 30, 1995 [JP] Japan ..... 7-013072

[51] Int. Cl.[6] ..... G10L 3/02

[52] U.S. Cl. ..... 704/219; 704/223; 704/229

[58] Field of Search ..... 395/2.16, 2.17, 395/2.28–2.34, 2.2, 2.23, 2.38, 2.39, 2.71–2.73, 2.91–2.95; 704/207, 208, 211, 214, 219–225, 229, 230, 262–264, 500–504

[56] References Cited

U.S. PATENT DOCUMENTS

| | | | |
|---|---|---|---|
| 5,142,584 | 8/1992 | Ozawa | 395/2.32 |
| 5,195,166 | 3/1993 | Hardwick et al. | 395/2.09 |
| 5,327,520 | 7/1994 | Chen | 395/2.28 |
| 5,371,853 | 12/1994 | Kao et al. | 395/2.32 |
| 5,602,961 | 2/1997 | Kolesnik et al. | 395/2.28 |

FOREIGN PATENT DOCUMENTS

| | | |
|---|---|---|
| 0 417 739 | 3/1991 | European Pat. Off. . |
| 0 628 946 | 12/1994 | European Pat. Off. . |
| 4-171500 | 4/1992 | Japan . |
| 4-363000 | 12/1992 | Japan . |
| 5-6199 | 1/1993 | Japan . |

OTHER PUBLICATIONS

"M-LCELP Speech Coding at 4 KBPS", Ozawa et al, ICASSP '94, pp. 269–272.

Ozawa, et al., "M-LCELP Speech Coding at 4 kb/s with Multi-Mode and Multi-Codebook", vol. E77-B, No. 9, pp. 1114–1121, Sep. 1994.

Nomura et al., "LSP Coding Usng VQ-SVQ With Interpolation In 4.075 KBPS M-LCELP Speech Coder", *Proc. Mobile Multimedia Communications*, pp. B.2.5-1–B.2.5-4, (1933).

Taniguchi et al., "Improved CEOP Speech Coding at 4 KBIT/s And Below", *Proc. ICSLP*, pp. 41–44, (1992).

*Primary Examiner*—Kee M. Tung
*Attorney, Agent, or Firm*—Foley & Lardner

[57] ABSTRACT

In a speech signal encoder device comprising a frame divider (31) for producing original speech frames, a mode decision circuit (49) decides a predetermined number of modes by using feature quantities which are extracted from each current speech frame segmented from an input speech signal at a predetermined frame period of as short as 5 ms and from a previous speech frame segmented at least one frame period prior to the current speech frame. Preferably, a weighing circuit (47) provides the current speech frame by perceptually weighting the original speech frames into weighed speech frames. It is possible to provide the feature quantities by a primary quantity and as a secondary quantity by a rate of variation in the primary quantity. Each feature quantity is preferably adjusted into an adjusted quantity in response to each current mode decided by using the current speech frame and a previous mode decided at least one frame period prior to the current mode. Each feature quantity may be a pitch prediction gain, a short-period predicted gain, a level, or a pitch of each original speech frame.

10 Claims, 14 Drawing Sheets

SPEECH ENCODER WITH FEATURES EXTRACTED FROM CURRENT AND PREVIOUS FRAMES

BACKGROUND OF THE INVENTION

This invention relates to a speech encoder device for encoding a speech or voice signal at a short frame period into encoder output codes having a high code quality.

A speech encoder device of this type is described as a speech codec in a paper contributed by Kazunori Ozawa and five others including the present sole inventor to the IEICE Trans. Commun. Volume E77-B, No. 9 (September 1994), pages 1114 to 1121, under the title of "M-LCELP Speech Coding at 4 kb/s with Multi-Mode and Multi-Codebook". According to this Ozawa et al paper, an input speech signal is encoded as follows.

The input speech signal is segmented or divided into original speech frames, each typically having a frame period or length of 40 ms. By LPC (linear predictive coding), extracted from the speech frames are spectral parameters representative of spectral characteristics of the speech signal. Before so calculating feature or characteristic quantities, it is preferred to convert the original speech frames to weighted speech frames by using a perceptual or auditory weight. The feature quantities are used in deciding modes of segments, such as vowel and consonant segments, to produce decided mode results indicative of the modes.

In an encoding part of this Ozawa et al encoder device, each original frame is subdivided into original subframe signals, each being typically 8 ms long. Such speech subframes are used in deciding excitation signals. In accordance with the modes, adaptive parameters (delay parameters corresponding to pitch periods and gain parameters) are extracted from an adaptive codebook for each current speech subframe based on a previous excitation signal. In this manner, the adaptive codebook is used in extracting pitches of the speech subframes with prediction. For a residual signal obtained by pitch prediction, an optimal excitation code vector is selected from a speech codebook (vector quantization codebook) composed of noise signals of a predetermined kind. The excitation signals are quantized by calculating an optimal gain.

The excitation code vector is selected so as to minimize an error power between the residual signal and a signal composed of selected noise signal. Either for transmission to a speech decoder device or storage in a recording device for later reproduction, a multiplexer is used to produce an encoder device output signal into which multiplexed are the mode results and indexes indicative of the adaptive parameters including the gain parameters and the kind of optimal excitation code vectors.

In a conventional speech encoder device of Ozawa et al, it is necessary on reducing a processing delay to use a short frame period for the original or the weighted speech frames. The feature quantities are subjected to considerable fluctuations with time when the frame period is 5 ms or shorter. The fluctuations give rise to unstable and erroneous interswitching of the modes and therefore in a deteriorated code quality.

Moreover, selected modes, predicted pitches, and extracted levels are subjected to appreciable fluctuations when the frame period is 5 ms or shorter. The appreciable fluctuations give rise, not only to the unstable and erroneous interswitching, but also to unstable and erroneous pitch extraction and level extraction and accordingly to a deteriorated code quality.

When the levels of the input speech signal are used on encoding the input speech signal, indexes indicative of the levels are additionally used in the encoder device output signal. When the pitches are used, the encoder device output signal need not include the indexes indicative of the pitches.

SUMMARY OF THE INVENTION:

In view of the foregoing, it is an object of the present invention to provide a speech encoder device operable with a short processing delay even when an input speech signal is segmented into original speech frames of a short frame period, such as 5 to 10 ms long or shorter.

It is another object of this invention to provide a speech encoder device which is of the type described and which can prevent feature quantities from being subjected to appreciable fluctuations with time.

It is still another object of this invention to provide a speech encoder device which is of the type described and which can exactly decide modes for the original frames or for weighted frames.

It is yet another object of this invention to provide a speech encoder device which is of the type described and which can exactly extract pitches from speech subframes.

It is a further object of this invention to provide a speech encoder device which is of the type described to produce encoder output codes of a high code quality.

Other objects of this invention will become clear as the description proceeds.

In accordance with an aspect of this invention, there is provided a speech signal encoder device comprising (a) segmenting means for segmenting an input speech signal into original speech frames at a predetermined frame period, (b) deciding means for using the original speech frames in deciding a predetermined number of modes of the original speech frames to produce decided mode results, and (c) encoding means for encoding the input speech signal into codes at the frame period and in response to the modes to produce the decided mode results and the codes as an encoder device output signal, wherein the deciding means decides the modes by using feature quantities of each current speech frame segmented from the input speech signal at the frame period and a previous speech frame segmented at least one frame period prior to the current speech frame.

In accordance with another aspect of this invention, there is provided a speech signal encoder device comprising (a) segmenting means for segmenting an input speech signal into original speech frames at a predetermined frame period, (b) extracting means for using the original speech frames in extracting pitches from the input speech signal, and (c) encoding means for encoding the input speech signal at the frame period and in response to the pitches into codes for use as an encoder device output signal, wherein the extracting means extracts the pitches by using each current speech frame segmented from the input speech signal at the frame period and a previous speech frame segmented at least one frame period prior to the current speech frame.

In accordance with a different aspect of this invention, there is provided a speech signal encoder device comprising (a) segmenting means for segmenting an input speech signal into original speech frames at a predetermined frame period, (b) deciding means for using the original speech frames in deciding a predetermined number of modes of the original speech frames to produce decided mode results, and (c) encoding means for encoding the input speech signal into codes at the frame period and in response to the modes to produce the decided mode results and the codes as an encoder device output signal, wherein the deciding means makes use, in deciding a current mode of the modes for each current speech frame segmented from the input speech signal at the frame period, of feature quantities of at least one kind extracted from the current speech frame and a previous speech frame segmented at least one frame period prior to the current speech frame and of a previous mode decided at least one frame period prior to the current mode.

In accordance with another different aspect of this invention, there is provided a speech signal encoder device comprising (a) segmenting means for segmenting an input speech signal into original speech frames at a predetermined frame period, (b) deciding means for using the original speech frames in deciding a predetermined number of modes of the original speech frames to produce decided mode results, (c) extracting means for extracting pitches from the input speech signal, and (d) encoding means for encoding the input speech signal into codes at the frame period and in response to the modes to produce the decided mode results and the codes as an encoder device output signal, wherein: (A) the extracting means comprises: (A1) feature quantity extracting means for extracting feature quantities by using at least each current speech frame segmented from the input speech signal at the frame period; and (A2) feature quantity adjusting means for using the feature quantities as the pitches to adjust the pitches into adjusted pitches in response to each current mode decided for the current speech frame and a previous mode decided at least one frame period prior to the current mode; (B) the encoding means encoding the input speech signal into the codes in response further to the adjusted pitches.

In accordance with still another different aspect of this invention, there is provided a speech signal encoder device comprising (a) segmenting means for segmenting an input speech signal into original speech frames at a predetermined frame period, (b) deciding means for using the original speech frames in deciding a predetermined number of modes of the original speech frames to produce decided mode results, (c) extracting means for extracting levels from the input speech signal, and (d) encoding means for encoding the input speech signal into codes at the frame period and in response to the modes to produce the decided mode results and the codes as an encoder device output signal, wherein: (A) the extracting means comprises: (A1) feature quantity extracting means for extracting feature quantities by using at least each current speech frame segmented from the input speech signal at the frame period; and (A2) feature quantity adjusting means for using the feature quantities as the levels to adjust the levels into adjusted levels in response to each current mode decided for the current speech frame and a previous mode decided at least one frame period prior to the current mode; (B) the encoding means encoding the input speech signal into the codes in response further to the adjusted levels.

Figure 1:
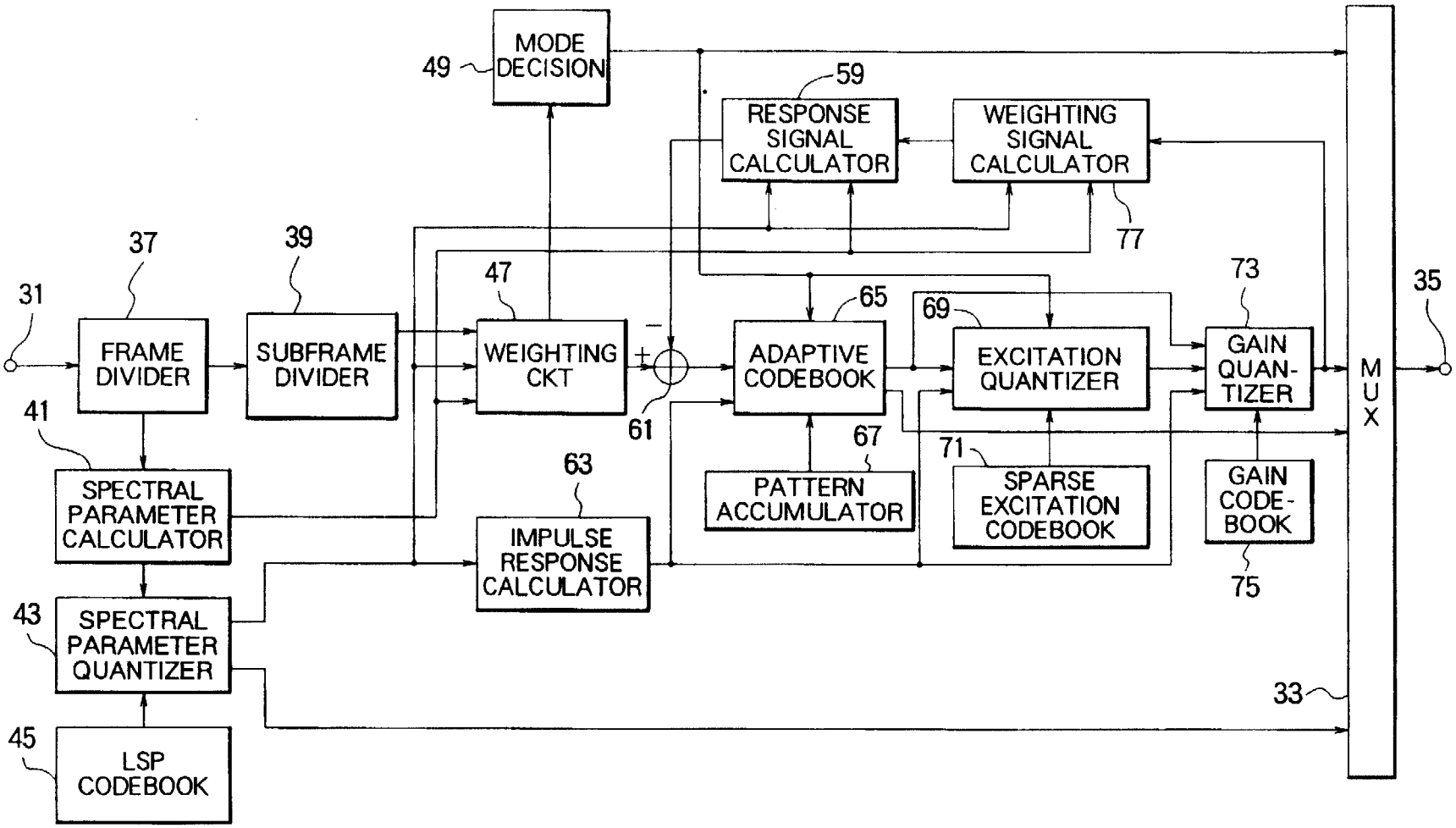
FIG. 1 is a block diagram of a speech signal encoder device according to a first embodiment of the instant invention.

DESCRIPTION OF THE PREFERRED EMBODIMENTS:

Referring t o FIG. 1, a speech signal encoder device is according to a first preferred embodiment of the present invention. An input speech or voice signal is supplied to the speech signal encoder device through a device input terminal 31. The speech signal encoder device comprises a multiplexer (MUX) 33 for delivering an encoder output signal to a device output terminal 35.

Delivered through the device input terminal 31, the input speech signal is segmented or divided by a frame dividing circuit 37 into original speech frames at a frame period which is typically 5 ms long. A subframe dividing circuit 39 further divides each original speech frame in to original speech subframes, each having a subframe period of, for example, 2.5 ms.

Although connected in FIG. 1 to the frame dividing circuit 37, a spectral parameter calculator 41 calculates spectral parameters of the input speech signal up to a predetermined order, such as up to a tenth order (P=10) by applying a window of a window length of typically 24 ms to at least one each of the speech subframes. In the example being illustrated, the spectral parameter calculator 41 calculates the spectral parameters according to Burg analysis described in a book written by Nakamizo and published 1988 by Korona-Sya under the title of, as transliterated according to ISO 3602, "Singô Kaiseki to Sisutemu Dôtei" (Signal Analysis and System Identification), pages 82 to 87. It is possible to use an LPC analyzer or a like as the spectral parameter calculator 41.

Besides calculating linear prediction coefficients $\alpha$ (i) by the Burg analysis for i=1, 2, . . . , and 10, the spectral parameter calculator 41 converts the linear prediction coefficients to LSP (linear spectral pair) parameters which are suitable to quantization and interpolation. In the spectral parameter calculator 41 being illustrated, the linear prediction coefficients are converted to the LSP parameters according to a paper contributed by Sugamura and another to the Transactions of the Institute of Electronics and Communication Engineers of Japan, J64-A (1981), pages 599 to 606, under the title of "Sen-supekutoru Tui Onsei Bunseki Gôsei Hosiki ni yoru Onsei Zyôhô Assyuku" (Speech Data Compression by LSP Speech Analysis-Synthesis Technique, as translated by the contributors).

More particularly, each speech frame consists of first and second subframes in the example being described. The linear prediction coefficients are calculated and converted to the LSP parameters for the second subframe. For the first subframe, the LSP parameters are calculated by linear interpolation of the LSP parameters of second subframes and are inverse converted to the linear prediction coefficients. In this manner, the spectral parameter calculator 41 produces LSP parameters and linear prediction coefficients $\alpha$ (i, p) for the first and the second subframes where p=1, 2, . . . and 5.

Supplied from the spectral parameter calculator 41 with the LSP parameters of each predetermined subframe, such as the second subframe, a spectral parameter quantizer 43 converts the linear prediction coefficients to converted prediction coefficients $\alpha'$(i, p) for each subframe. Furthermore, the spectral parameter quantizer 43 vector quantizes the linear prediction coefficients.

To speak of this vector quantization first, it is possible to use various known methods. An example is described in a paper contributed by Toshiyuki Hamada and three others to the Proc. Mobile Multimedia Communications, pages B.2.5-1 to B.2.5-4 (1933), under the title of "LSP Coding Using VQ-SVQ with Interpolation in 4.075 kbps M-LCELP Speech Coder". Other examples are disclosed in Japanese Patent Prepublication (A) Nos. 171,500 of 1992, 363,000 of 1992, and 6,199 of 1993. In the example being illustrated, use is made of an LSP codebook 45.

As for conversion into the converted prediction coefficients, the spectral parameter quantizer 43 first reproduces the LSP parameters for the first and the second subframes from the LSP parameters quantized in connection with each second subframe. In practice, the LSP parameters are reproduced by linear interpolation between the quantized prediction coefficients of a current one of the second subframes and those of a previous one of the second subframes that is one frame period prior to the current one of the second subframes.

More in detail, the spectral parameter quantizer 43 is operable as follows. First, a code vector is selected so as to minimize an error power between the LSP parameters before and after quantization and then reproduces by linear interpolation the LSP parameters for the first and the second subframes. In order to achieve a high quantization efficiency, it is possible to preselect a plurality of code vector candidates for minimization of the error power, to calculate cumulative distortions in connection with the candidates, and to select one of combinations of interpolated LSP parameters that minimizes the cumulative distortions.

Alternatively, it is possible instead of the linear interpolation to prepare interpolation LSP patterns for a predetermined number of bits, such as two bits, and to select one of combinations of the interpolation LSP patterns that minimizes the cumulative distortions as regards the first and the second subframes. This results in an increase in an amount of output information although this makes it possible to more exactly follow variations of the LSP parameters in each speech frame.

It is possible either to prepare the interpolation LSP patterns by learning of LSP data for training or to store predetermined patterns. For storage, the patterns may be those described in a paper contributed by Tomohiko Taniguchi and three others to the Proc. ICSLP (1992), pages 41 to 44, under the title of "Improved CELP Speech Coding at 4 kbit/s and below". Alternatively, it is possible for further improved performance to preselect the interpolation LSP patterns, to calculate an error signal between actual values of the LSP parameters and interpolated LSP values, and to quantize the error signal with reference to an error codebook (not shown).

The spectral parameter quantizer 43 produces the converted prediction coefficients for the subframes. In addition, the spectral parameter quantizer 43 supplies the multiplexer 33 with indexes indicative of the code vectors selected for quantized prediction coefficients in connection with the second subframes.

Connected to the subframe dividing circuit 39 and to the spectral parameter calculator and quantizer 41 and 43, a perceptual weighting circuit 47 gives perceptual or auditory weights $\gamma^i$ to respective samples of the speech subframes to produce a perceptually weighted signal x[w](n), where n represents sample identifiers of the respective speech samples in each frame. The weights are decided primarily by the linear prediction coefficients.

Supplied with the perceptually weighted signal frame by frame, a mode decision circuit 49 extracts feature quantities from the perceptually weighted signal. Furthermore, the mode decision circuit 49 uses the feature quantities in deciding modes as regards frames of the perceptually weighted signal to produce decided mode results indicative of the modes.

Figure 2:
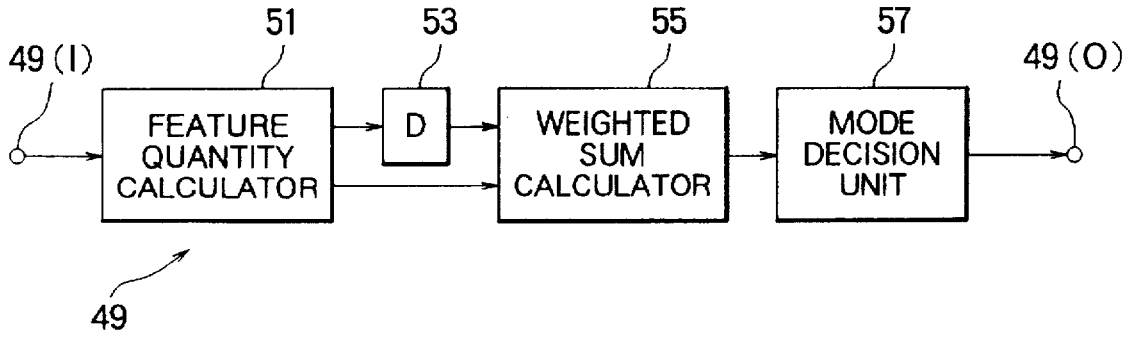
FIG. 2 is a block diagram of a mode decision circuit used in the speech signal encoder device illustrated in FIG. 1.

Turning temporarily to FIG. 2 with FIG. 1 continuously referred to, the mode decision circuit 49 is operable as follows in the speech encoder device being illustrated. The mode decision circuit 49 has mode decision circuit input and output terminals 49(I) and 49(O) supplied with the perceptually weighted signal and producing the decided mode results.

Supplied through the mode decision circuit input terminal 49(I) with the perceptually weighted signal frame by frame, a feature quantity calculator 51 calculates in this example a pitch prediction gain G. A frame delay (D) 53 is for giving one frame delay to the pitch prediction gain to produce a one-frame delayed gain. A weighted sum calculator 55 calculates a weighted sum Gav of the pitch prediction gain and the one-frame delayed gain according to:

$$Gav = \sum_{i=1}^{2} v(i)G(i),$$

where v (i) represents gain weights for i-th subframes.

The feature quantities are given typically by such weighted sums in connection with each current frame and a previous frame which is one frame period prior to the current frame. Supplied with the feature quantities, a mode decision unit 57 selects one of the modes for each current frame and delivers the decided mode results in successive frame periods to the mode decision circuit output terminal 49(O).

The mode decision unit 57 has a plurality of predetermined threshold values, for example, three in number. In this event, the modes are four in number. The decided mode results are delivered to the multiplexer 33.

In FIG. 1, the spectral parameter calculator and quantizer 41 and 43 supply a response signal calculator 59 with the linear prediction coefficients subframe by subframe and with the converted prediction coefficients also subframe by subframe. The response signal calculator 59 keeps filter memory values for respective subframes. In response to a response calculator input signal d(n) which will presently become clear, the response signal calculator 59 calculates a response signal x[z](n) for each subframe according to:

$$x[z](n) = d(n) - \sum_{i=1}^{10} \alpha(i)d(n-i) + \sum_{i=1}^{10} \alpha(i)\gamma^i y(n-i) + \sum_{i=1}^{10} \alpha'(i)\gamma^i x[z](n-i),$$

where:

$$y(n) = d(n) - \sum_{i=1}^{10} \alpha(i)d(n-i) + \sum_{i=1}^{10} \alpha(i)\gamma^i y(n-i).$$

Connected to the perceptual weighting circuit 47 and to the response signal calculator 59, a speech subframe subtracter 61 subtracts the response signal from the perceptually weighted signal to produce a subframe difference signal according to:

$$x[w]'(n) = x[w](n) - x[z](n).$$

Connected to the spectral parameter quantizer 45, an impulse response calculator 63 calculates, at a predetermined number L of points, impulse responses h[w](n) of a weighted filter of the z-transform which is represented as:

$$H[w](z) = \left(1 - \sum_{i=1}^{10} \alpha(i)z^{-i}\right) \div \left(1 - \sum_{i=1}^{10} \alpha'(i)\gamma^i z^{-i}\right)^2.$$

Controlled by the modes decided by the mode decision circuit 49 and by the impulse responses calculated by the impulse response calculator 63, an adaptive codebook circuit 65 is connected to the subframe subtracter 61 and to a pattern accumulating circuit 67. Depending on the modes, the adaptive codebook circuit 65 calculates pitch parameters and supplies the multiplexer 33 with a prediction difference signal defined by:

$$z(n) = x[w]'(n) - b(n),$$

where b(n) represents a pitch prediction signal given by:

$$b(n) = v(n-T) * h[w](n),$$

where, in turn, β represents the gain of the adaptive codebook circuit 65, v(n) representing here an adaptive code vector, and T representing a delay. The asterisk mark represents convolution.

Controlled by the modes decided by the mode decision circuit 49 and by the impulse responses calculated by the impulse response calculator 63, an excitation quantizer 69 is supplied with the prediction difference signal from the adaptive codebook circuit 65 and refers to a sparse excitation codebook 71. Being of a non-regular pulse type, the sparse excitation codebook 71 keeps excitation code vectors, each of which is composed of non-zero vector components of an individual non-zero number or count. The excitation quantizer 69 produces, as optimal excitation code vectors c[j](n), either a part or all of the excitation code vectors to minimize j-th differences defined by:

$$D(j) = \sum_n [z(n) - \gamma(j)c[j](n)h[w](n)]^2.$$

Controlled by the impulse responses calculated by the impulse response calculator 63 and supplied with the prediction difference signal from the adaptive codebook circuit 65 and with the excitation code vectors selected by the excitation quantizer 69, a gain quantizer 73 refers to a gain codebook 75 of gain code vectors. Reading the gain code vectors, the gain quantizer 73 selects combinations of the excitation code vectors and the gain code vectors so as to minimize (j,k)-th differences defined by:

$$D(j,k) = \sum_n [x[w](n) - \beta'(k)v(n-T)h[w](n) - \gamma'(k)c[j](n)h[w](n)]^2,$$

where β'(k) and γ'(k) represent a k-th two-dimensional code vector of the gain code vectors. Selecting the combinations, the gain quantizer 73 supplies the multiplexer 33 with the indexes indicative of the excitation and the gain code vectors of such selected combinations.

In the Ozawa et al paper cited hereto before, the excitation quantizer 69 selects at least two kinds, such as for an unvoiced and a voiced mode, of optimal excitation code vectors. In the example being illustrated, the gain quantizer 73 selects the optimal code vectors produced by the excitation quantizer 69 under control by the modes. It is possible upon selection by the gain quantizer 73 to specify the optimal excitation code vectors of a single kind. Alternatively, it is possible on applying the above-described equation for the j-th differences D(j) only to a part of the excitation code vectors to preliminarily select excitation code vector candidates for application of the equation in question to the excitation code vector candidates, to select the optimal code vectors of only one kind from the excitation code vector candidates.

Connected to the spectral parameter calculator and quantizer 41 and 43 and to the gain quantizer 73, a weighting signal calculator 77 reads the excitation and the gain code vectors with reference to their indexes and calculates a drive excitation signal v(n) according to:

$$v(n)=\beta'(n)v(n-T)+\gamma'(k)c[j](n).$$

Subsequently, the weighting signal calculator 77 calculates a weighting signal s[w](n) for delivery to the response signal calculator 59 according to:

$$\begin{aligned} s[w](n) &= v(n) - \\ &\quad \sum_{i=1}^{10} \alpha(i)v(n-i) + \sum_{i=1}^{10} \alpha(i) + \\ &\quad \gamma^i p(n-i) + \\ &\quad \sum_{i=1}^{10} \alpha'(i)\gamma^i s[w](n-i), \end{aligned}$$

where:

$$\begin{aligned} p(n) &= v(n) - \sum_{i=1}^{10} \alpha(i)v(n-i) + \\ &\quad \sum_{i=1}^{10} \alpha(i)\gamma^i p(n-i). \end{aligned}$$

It is now understood in connection with the example being illustrated that the modes are decided either for each original speech frame or for each weighted speech frame by the feature quantities extracted from the input speech signal for a longer period which is longer than one frame period. Even if the frame period is only 5 ms long or shorter and if the feature quantities may be erroneous when extracted from the current speech frame alone, the previous speech frame would give correct and precise feature quantities when the previous speech frame is at least one frame period prior to the current speech frame. As a consequence, it is possible for unstable and erroneous interswitching of the modes to prevent the code quality from deteriorating.

Figure 3:
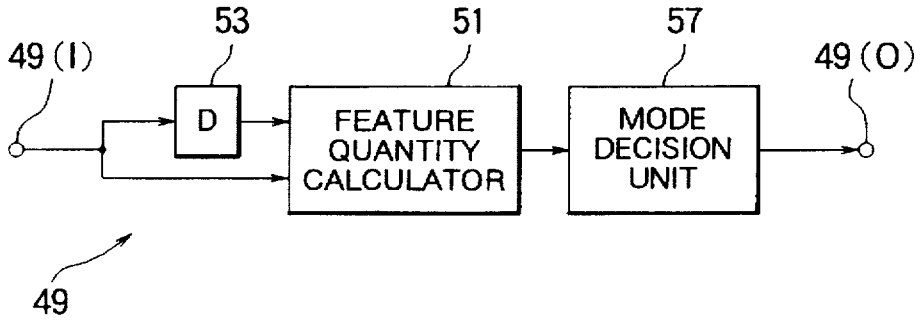
FIG. 3 is a block diagram of another mode decision circuit for use in a speech signal encoder device according to a second embodiment of this invention.

Referring to FIG. 3 with FIGS. 1 and 2 continuously referred to, another mode decision circuit is for use in a speech signal encoder device according to a second preferred embodiment of this invention. Throughout the following, similar parts are designated by like reference numerals and are similarly operable with likewise named signals unless specifically otherwise mentioned. This mode decision circuit is therefore designated by the reference numeral 49. Except for the mode decision circuit 49 which will be described in the following, the speech signal encoder device is not different from that illustrated with reference to FIG. 1.

In the mode decision circuit 49 being illustrated, the frame delay 53 is connected directly to the mode decision circuit input terminal 49(I). Supplied from the perceptual weighting circuit 47 with the perceptually weighted signal through the mode decision circuit input terminal 49(I), the frame delay 53 produces a delayed weighted signal with a one-frame delay.

Connected to the frame delay 53 and to the mode decision circuit input terminal 49(I), the feature quantity calculator 51 calculates a pitch prediction gain G for each speech frame as the feature quantities. The pitch prediction gain is calculated according to:

$$G = 10 \log_{10}(P/E),$$

where:

$$P = \sum_{n=-N+1}^{N-1} x[w]^2(n)$$

and $$E = P - \left[ \sum_{n=-N+1}^{N-1} x[w](n)x[w](n-T) \right]^2 \div \left[ \sum_{n=-N+1}^{N-1} x[w]^2(n-T) \right],$$

where, in turn, T represents here an optimal delay that maximizes such prediction delays, N representing a total number of speech samples in each frame.

Connected to the feature quantity calculator 51, the mode decision unit 57 compares the pitch prediction gain with predetermined threshold values to decide modes of the input speech signal from frame to frame. The modes are delivered as decided mode results through the mode decision circuit output terminal 49(O) to the multiplexer 33, the adaptive codebook circuit 65, and the excitation quantizer 69.

In the speech signal encoder device including the mode decision circuit 49 being illustrated, mode information is produced as an average for more than one frame period. This makes it possible to suppress deterioration which would otherwise take place in the code quality.

Figure 4:
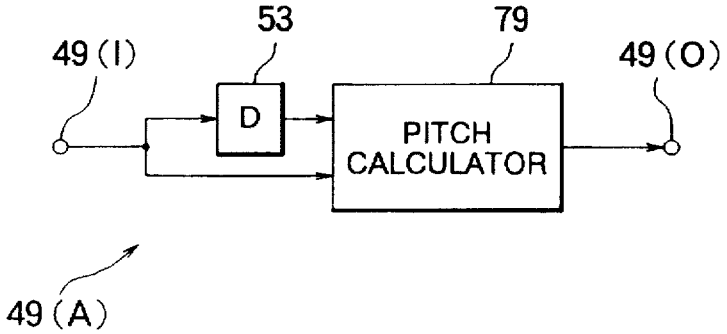
FIG. 4 is a block diagram of a pitch extracting circuit for use in a speech encoder device according to a third embodiment of this invention.

Further turning to FIG. 4 with FIGS. 1 and 2 continuously referred to, a pitch extracting circuit is for use in a speech signal encoder device according to a third preferred embodiment of this invention. The pitch extracting circuit is used in place of the mode deciding circuit 49 and is therefore designated by a similar reference symbol 49(A). In other respects, the speech signal encoder device is not much different from that illustrated with reference to FIG. 1 except for the adaptive codebook circuit 65 which is now operable as will shortly be described.

In FIG. 4, pitch extracting circuit input and output terminals correspond to the mode decision circuit input and output terminals 49(I) and 49(O) described in conjunction with FIG. 2 and are consequently designated by the reference symbols 49(I) and 49(O). The pitch extracting circuit 49(A) comprises the frame delay 53 connected directly to the pitch extracting circuit input terminal 49(I) as in the mode decision circuit 49 described with reference to FIG. 3.

Connected to the frame delay 53 and to the pitch extracting circuit input terminal 49(I) is a pitch calculator 79. Supplied from the perceptual weighting circuit 47 through the pitch extracting circuit input terminal 49(I) with the perceptually weighted signal as an undelayed weighted signal and from the frame delay 53 with the delayed weighted signal, the pitch calculator 79 calculates pitches T (the same reference symbol being used) which maximizes a novel error power E(T) defined by:

$$E(T) = \sum_{n=-N+1}^{N-1} x[w]^2(n) - \left[ \sum_{n=-N+1}^{N-1} x[w](n)x[w](n-T) \right]^2 \div \left[ \sum_{n=-N+1}^{N-1} x[w]^2(n-T) \right].$$

Extracting the pitches T from the input speech signal in this manner, the pitch extracting circuit 49(A) delivers the pitches to the adaptive codebook circuit 65. Although connections are depicted in FIG. 1 between the mode deciding circuit 49 and the multiplexer 33 and between the mode deciding circuit 49 and the excitation quantizer 69, it is unnecessary for the pitch extracting circuit 49(A) to deliver the pitches to the multiplexer 33 and to the excitation quantizer 69.

Supplied from the pitch extracting circuit 49(A) with the pitches, the adaptive codebook unit 65 closed-loop searches for lag parameters near the pitches in the subframes of the subframe difference signal. Furthermore, the adaptive codebook circuit 65 carries out pitch prediction to produce the prediction difference signal z(n) described before.

It has been confirmed that the pitch extracting circuit 49(A) is excellently operable. In the Ozawa et al paper cited before, the pitches T are calculated so as to minimize a conventional error power defined by:

$$E(T)=\sum_{n=0}^{N-1} x[w]^2(n)-\left[\sum_{n=0}^{N-1} x[w](n)x[w](n-T)\right]^2 + \left[\sum_{n=0}^{N-1} x[w]^2(n-T)\right].$$

In contrast, the pitch extracting circuit 49(A) calculates for each original or weighted speech frame an averaged pitch over two or more frame periods. This avoids extraction of unstable and erroneous pitches and prevents the code quality from being inadvertently deteriorated.

Figure 5:
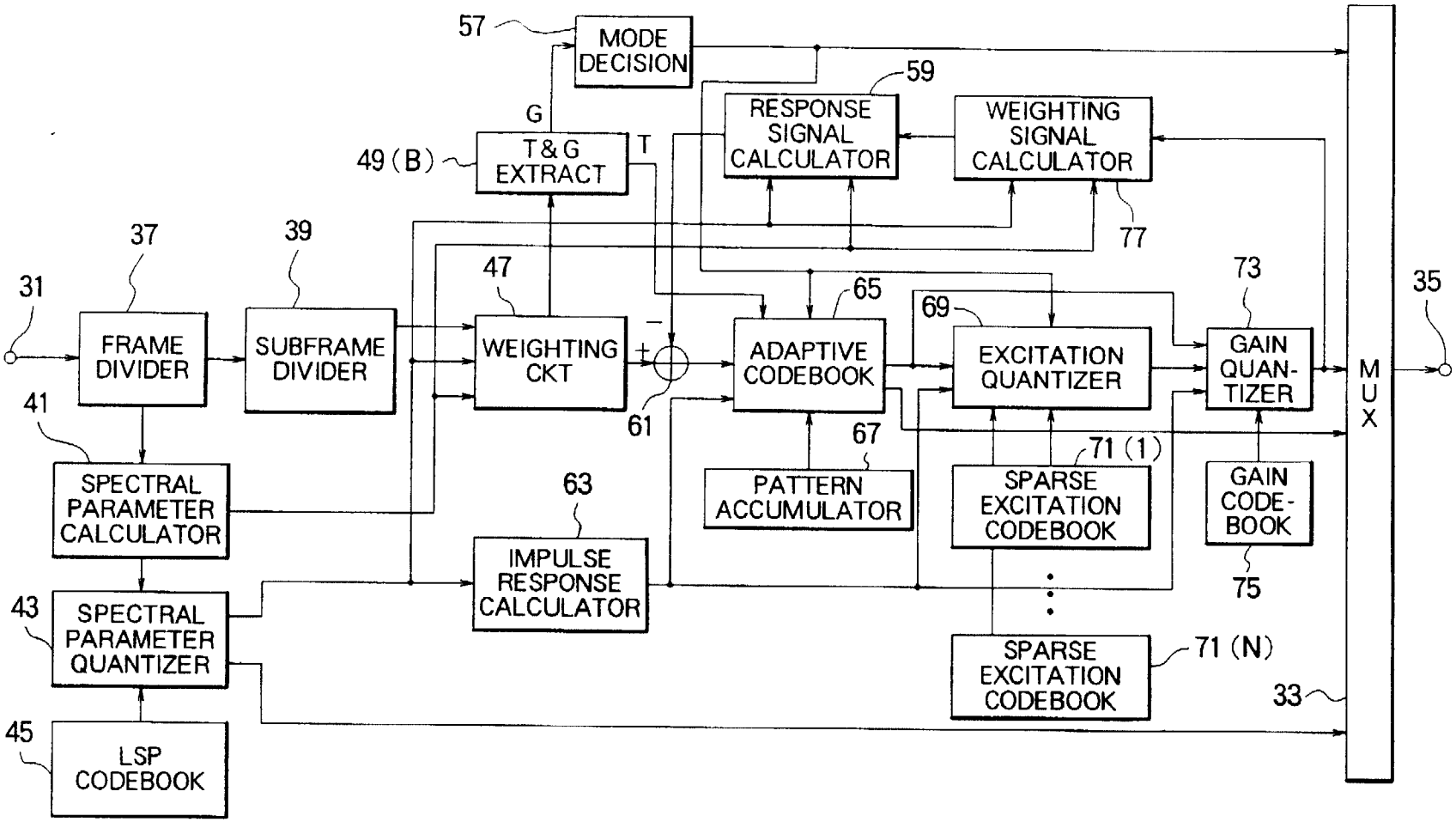
FIG. 5 is a block diagram of a speech signal encoder device according to a fourth embodiment of this invention.

Referring afresh to FIG. 5, a speech signal encoder device is similar, according to a fourth preferred embodiment of this invention, to that illustrated with reference to FIGS. 1 and 4.

Between the perceptual weighting unit 47 and the mode decision unit 57 which is described in connection with FIG. 3, use is made of a pitch and pitch prediction gain (T & G) extracting circuit 49(B) connected to the adaptive codebook circuit 65. Instead of the sparse excitation codebook 71, first through N-th sparse excitation codebooks 71(1) through 71(N) are connected to the excitation quantizer 69.

It is possible to understand that FIG. 4 shows also the pitch and pitch prediction gain extracting circuit 49(B). A pitch and predicted pitch gain extracting circuit input terminal is connected to the perceptual weighting circuit 47 to correspond to the mode decision or the pitch extracting circuit input terminal and is designated by the reference symbol 49(I). A pitch and pitch prediction gain calculator 79(A) is connected to the frame delay 53 like the pitch gain calculator 79 and calculates the pitches T to maximize the novel error power defined before and the pitch prediction gain G by using the equation which is given before and in which E is clearly equal to the novel error power. In the manner understood from FIG. 5, the pitch and pitch prediction gain extracting unit 49(B) has two pitch and pitch prediction gain extracting circuit output terminals connected to the pitch and pitch prediction gain calculator 79(A) instead of only one pitch extracting circuit output terminal 49(O).

One of these two output terminals is for the pitches T and is connected to the adaptive codebook circuit 65. The other is for the pitch prediction gain G and is connected to the mode decision circuit 49, which uses such pitch prediction gains as the feature quantities.

The adaptive codebook circuit 65 is controlled by the modes and is operable to closed-loop search for the lag parameters in the manner described above. The excitation quantizer 69 uses either a part or all of the excitation code vectors stored in the first through the N-th excitation codebooks 71(1) to 71(N).

Figure 6:
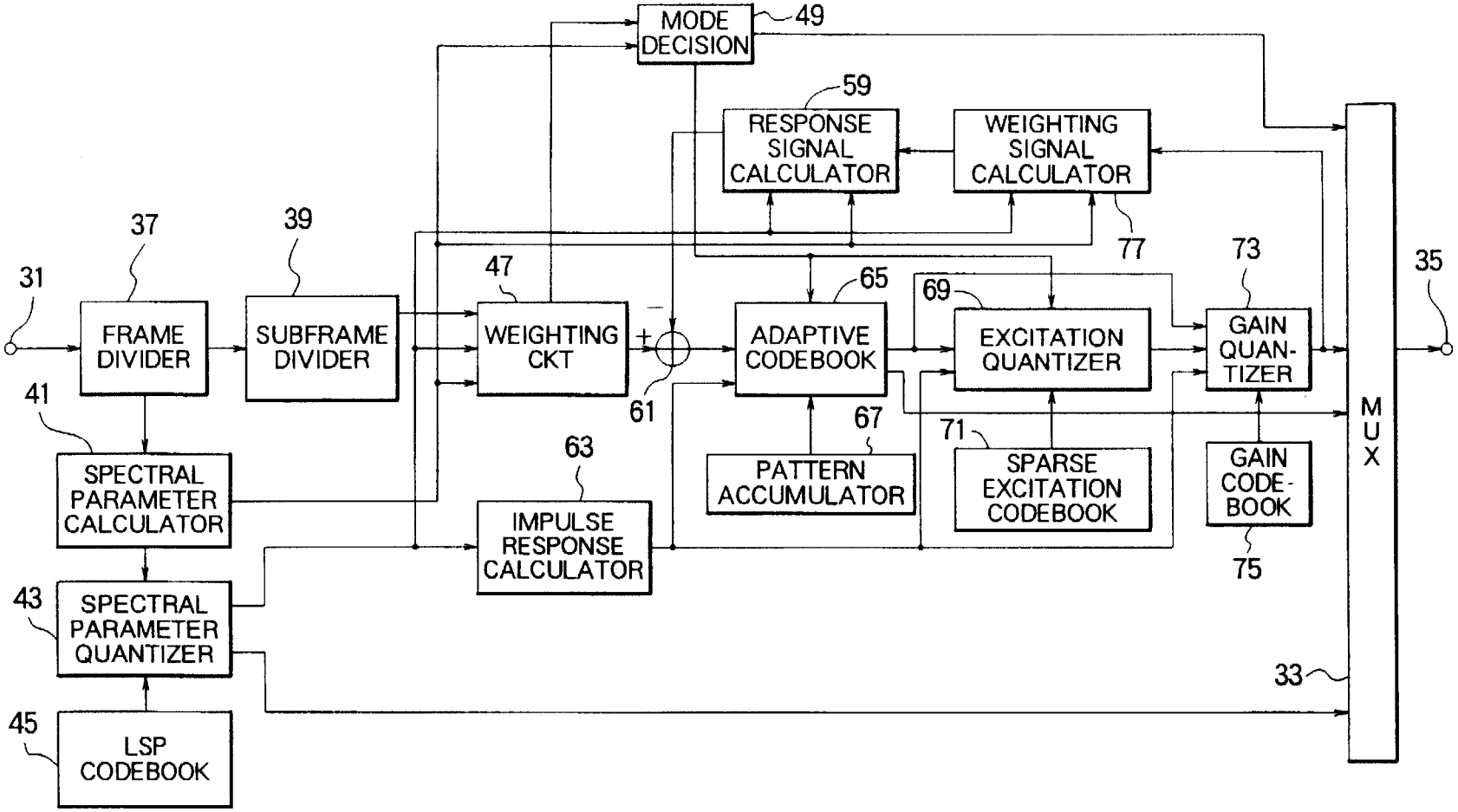
FIG. 6 is a block diagram of a speech signal encoder device according to a fifth embodiment of this invention.

Referring now to FIG. 6, the description will proceed to a speech signal encoder device according to a fifth preferred embodiment of this invention. This speech signal encoder device is similar to that illustrated with reference to FIG. 1 except for the following. That is, the mode decision circuit 49 is supplied from the spectral parameter calculator 41 with the spectral parameters α (i, p) for the first and the second subframes besides supplied from the perceptual weighing circuit 47 with the weighted speech subframes x[w](n) at the frame period.

Figure 7:
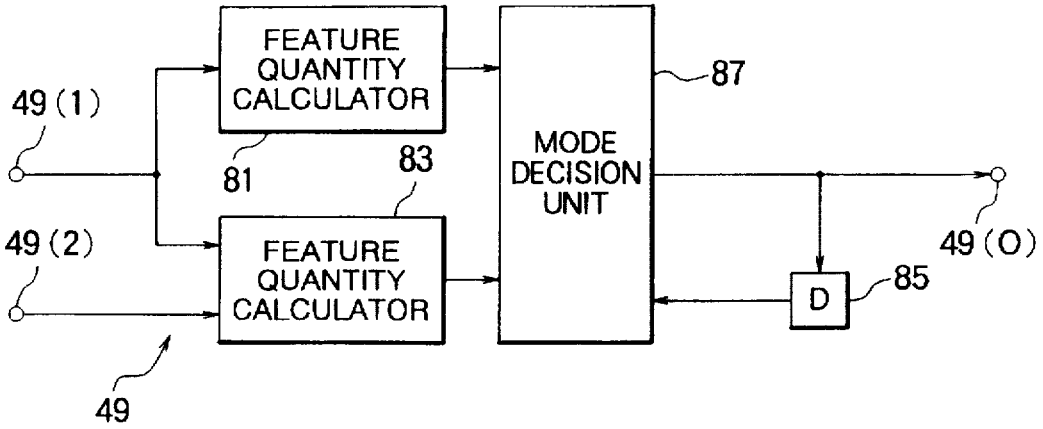
FIG. 7 is a block diagram of a mode decision circuit used in the speech signal encoder device illustrated in FIG. 6.

Turning to FIG. 7 with FIG. 6 continuously referred to, the mode decision circuit 49 has first and second circuit input terminals 49(1) and 49(2) connected to the perceptual weighting circuit 47 and to the spectral parameter calculator 41, respectively. Corresponding to the mode decision circuit output terminal described in connection with FIG. 2, a sole circuit output terminal is designated by the reference symbol 49(O) and connected to the multiplexer 33 and to the adaptive codebook circuit 65 and the excitation quantizer 69.

Connected to the first circuit input terminal 49(1), a first feature quantity calculator 81 calculates primary feature quantities, such as the pitch prediction gains which are described before and will hereafter be indicated by PG. Connected to the first and the second circuit input terminals 49(1) and 49(2), a second feature quantity calculator 83 calculates secondary feature quantities which may be short-period or short-term predicted gains SG.

Supplied with the primary and the secondary feature quantities and with delayed mode information through a frame delay 85, a mode decision unit 87 selects one of the modes for each current frame as output mode information like the mode decision unit 57 described in conjunction with FIG. 2 by comparing a combination of the primary and the secondary feature quantities and the delayed mode information with the predetermined threshold values of the type described before. The output mode information is delivered to the sole circuit output terminal 49(O) and to the frame delay 85, which gives a delay of one frame period to supply the delayed mode information back to the mode decision unit 87. It is preferred that the combination of the delayed mode information and the primary and the secondary feature quantities should be a weighted combination of the type of the weighted sum Gav described in connection with FIG. 2.

In other respects, operation of this speech signal encoder device is not different from that described in conjunction with FIG. 1. It is possible with the mode decision circuit 49 described with reference to FIG. 7 to achieve the above-pointed out technical merits.

Figure 8:
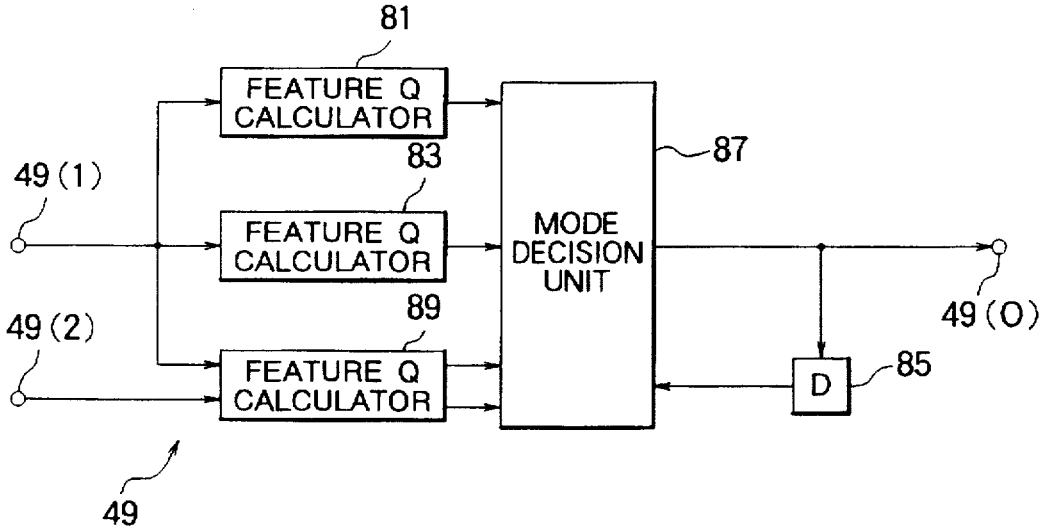
FIG. 8 is a block diagram of another mode decision circuit for use in the speech signal encoder device shown in FIG. 6.

Referring to FIG. 8, another mode decision circuit is for use in the speech signal encoder device described in the foregoing and is designated again by the reference numeral 49.

As illustrated with reference to FIG. 7, this mode decision circuit 49 has the first and the second circuit input terminals 49(1) and 49(2) and the sole circuit output terminal 49(O) and comprises the first and the second feature quantity calculators 81 and 83, the frame delay 85, and the mode decision unit 87. Operable in the manner described in conjunction with FIG. 7, the first feature quantity calculator 81 delivers the pitch prediction gains PG to the mode decision unit 87. In the example being illustrated, the second feature quantity calculator 83 is supplied only with the weighted speech subframes and calculates, for supply to the mode decision unit 87, RMS ratios RR as the secondary feature quantities in the manner which will presently be described. Connected to the first and the second circuit input terminals 49(1) and 49(2) and being operable as will shortly be described, a third feature quantity calculator 89 calculates, for delivery to the mode decision unit 87, the short-period predicted gains SG and short-period predicted gain ratios SGR collectively as ternary feature quantities. The frame delay 85 and the mode decision unit 87 are operable in the manner described above.

Figure 9:
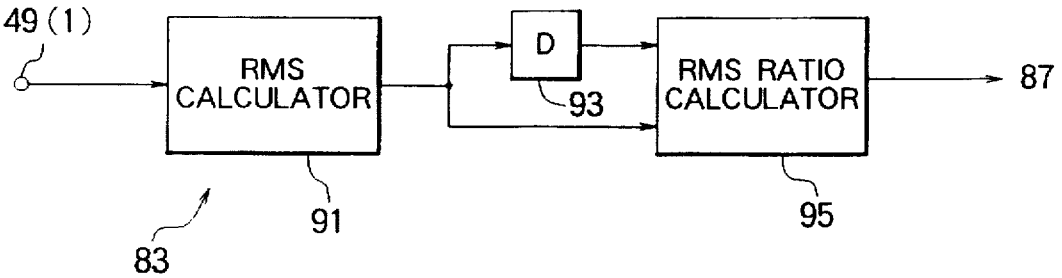
FIG. 9 shows in blocks a feature quantity calculator used in the mode decision circuit depicted in FIG. 8.

Turning to FIG. 9 and FIGS. 6 and 8 again referred to, the second feature quantity calculator 83 comprises an RMS calculator 91 supplied with the weighted speech subframes frame by frame through the first circuit input terminal 49(1) to calculate RMS values R which are used in the Ozawa et al paper. Connected to the RMS calculator 91, a frame delay (D) 93 gives a delay of one frame period to the RMS values to produce delayed values. Supplied with the RMS values and the delayed values, an RMS ratio calculator 95 calculates the RMS ratios for delivery to the mode decision unit 87. Each RMS ratio is a rate of variation of the RMS values with respect to a time axis scaled by the frame period.

Figure 10:
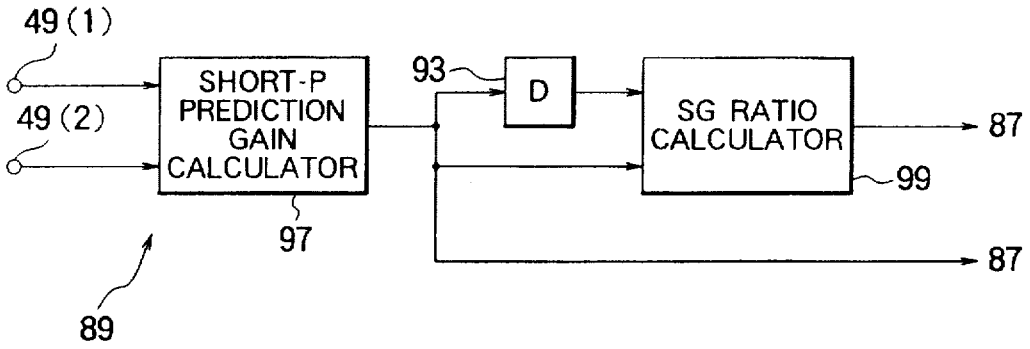
FIG. 10 shows in blocks another feature quantity calculator used in the mode decision circuit depicted in FIG. 8.

Further turning to FIG. 10 with FIGS. 6 and 8 continuously referred to, the third feature quantity calculator 89 comprises a short-period predicted gain (SG) calculator 97 connected to the first and the second circuit input terminals 49(1) and 49(2) to calculate the short-period predicted gains for supply to the mode decision unit 87. Although separated from the frame delay described in conjunction with FIG. 9, a frame delay (D) is indicated by the reference numeral 93 merely for convenience of illustration and is similarly operable to produce delayed prediction gains which are related to the previous frame described before. Responsive to the short-period prediction gains and to the delayed prediction gains, a short-period prediction gain ratio (SGR) calculator 99 calculates the short-period predicted gain ratios for delivery to the mode decision unit 87.

Figure 11:
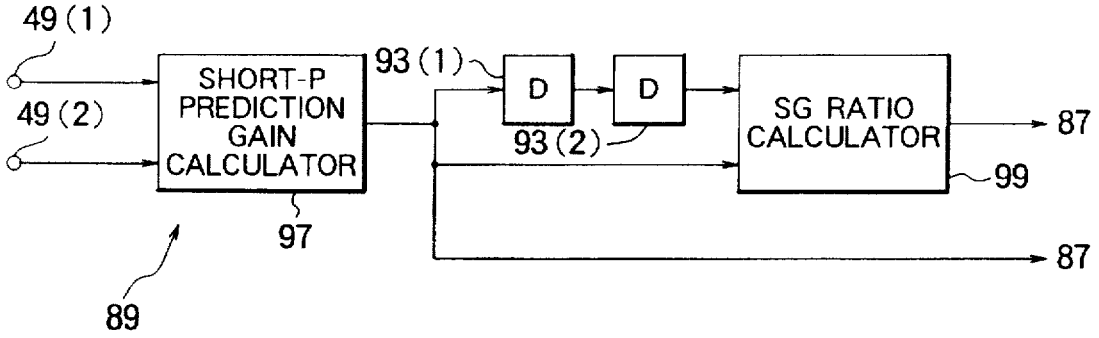
FIG. 11 shows in blocks a different feature quantity calculator for use in place of the feature quantity calculator illustrated in FIG. 10.

Still further turning to FIG. 11 with FIGS. 6 and 8 continuously referred to, the third feature quantity calculator 89 comprises first and second frame delays 93(1) and 93(2) in place of the frame delay 93 depicted in FIG. 9. As a consequence, the third feature quantity calculator 89 supplies the mode decision unit 87 with the short-period predicted gains which are calculated by comparing the predetermined threshold values with a sum, preferably a weighted sum, calculated in each frame by a short-period predicted gain and a delayed predicted gain delivered from the first and the second frame delays 93(1) and 93(2) with a total delay of two frame periods given to the short-period predicted gain.

Figure 12:
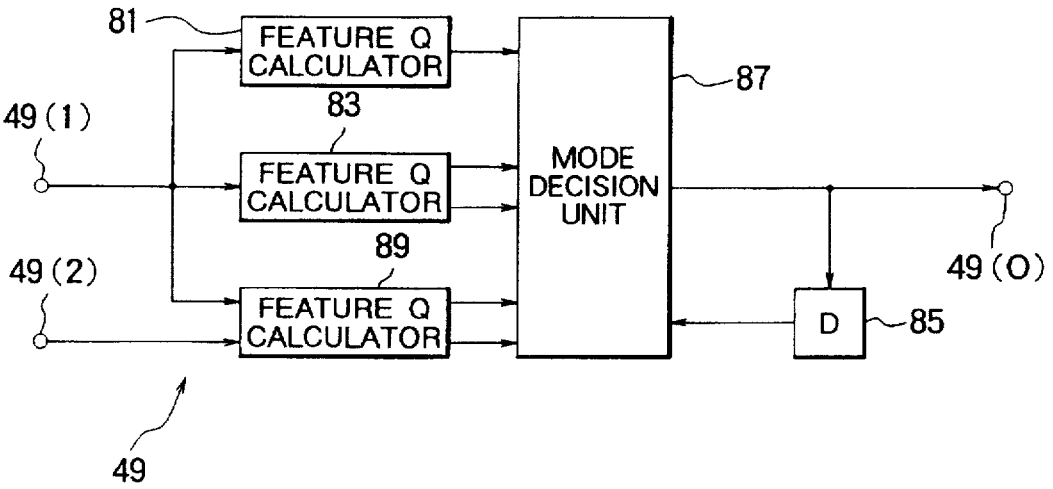
FIG. 12 is a block diagram of still another mode decision circuit for use in the speech signal encoder device shown in FIG. 6.

Referring to FIG. 12 with FIG. 6 continuously referred to, the mode decision circuit 49 is similar partly to that described in connection with FIG. 8 and partly to that of FIG. 9. More particularly, the second feature quantity calculator 83 supplies the mode decision unit 87 with the RMS values R in addition to the RMS ratios RR. The first and the third feature quantity calculators 81 and 89, the frame delay 85, and the mode decision unit 87 are operable in the manner described before.

Figure 13:
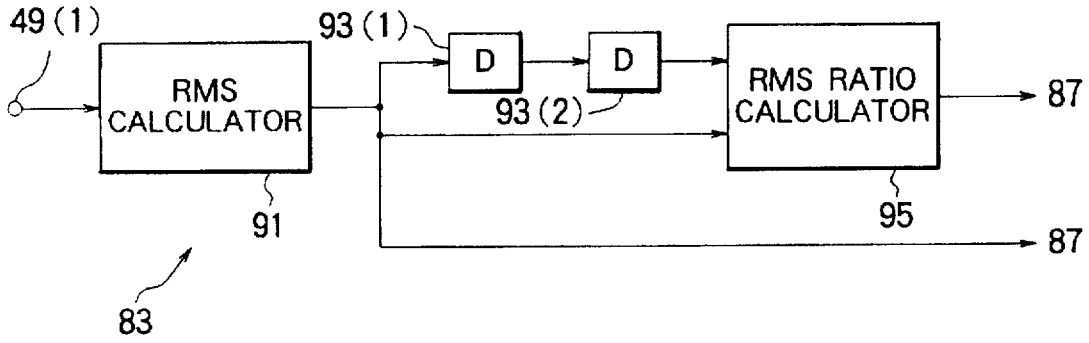
FIG. 13 shows a feature quantity calculator used in the mode decision circuit depicted in FIG. 12.

Turning to FIG. 13 with FIG. 12 continuously referred to, the second feature quantity calculator 83 is similar to that illustrated with reference to FIG. 9. The RMS calculator 91 delivers, however, the RMS values directly to the mode decision unit 87. In addition, the RMS calculator 91 delivers the RMS values to the RMS ratio calculator 95 directly and through a series connection of first and second frame delays (D) which are separate from those described in connection with FIG. 11 and nevertheless are designated by the reference numerals 93(1) and 93(2). It is now understood that the RMS ratio calculator 95 calculates the RMS ratio of each current RMS value to a previous RMS value which is two frame periods prior to the current RMS value.

Further turning to FIG. 14 with FIGS. 6 and 12 again referred to, the second feature vector calculator 83 is similar to that described with reference to FIG. 9. The RMS calculator 91 delivers, however, the RMS values directly to the mode decision unit 87 besides to the frame delay 93 and to the RMS ratio calculator 95.

Figure 15:
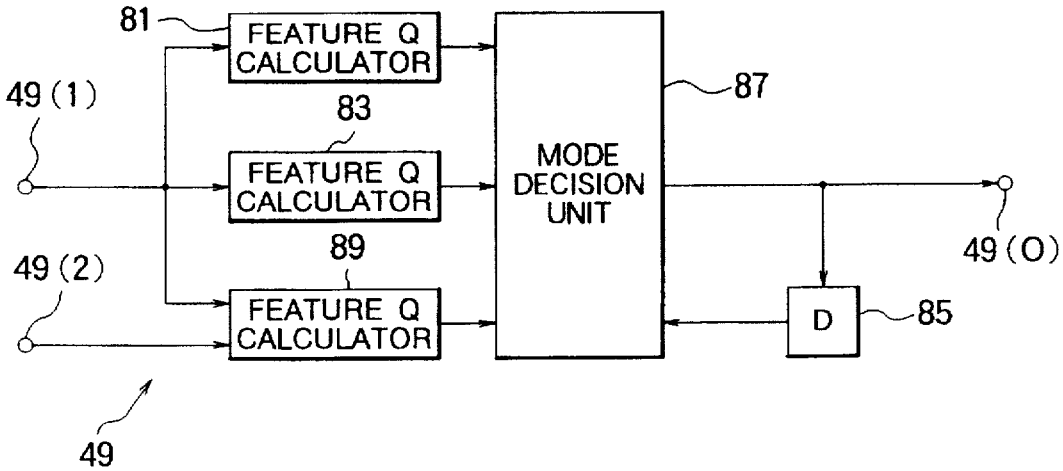
FIG. 15 is a block diagram of yet another mode decision circuit for use in the speech encoder device shown in FIG. 6.

Referring to FIG. 15 with FIG. 6 continuously referred to, the mode decision circuit 49 is similar to that described with reference to FIG. 12. The second feature quantity calculator 83 delivers, however, only the RMS values R to the mode decision unit 87.

Figure 16:
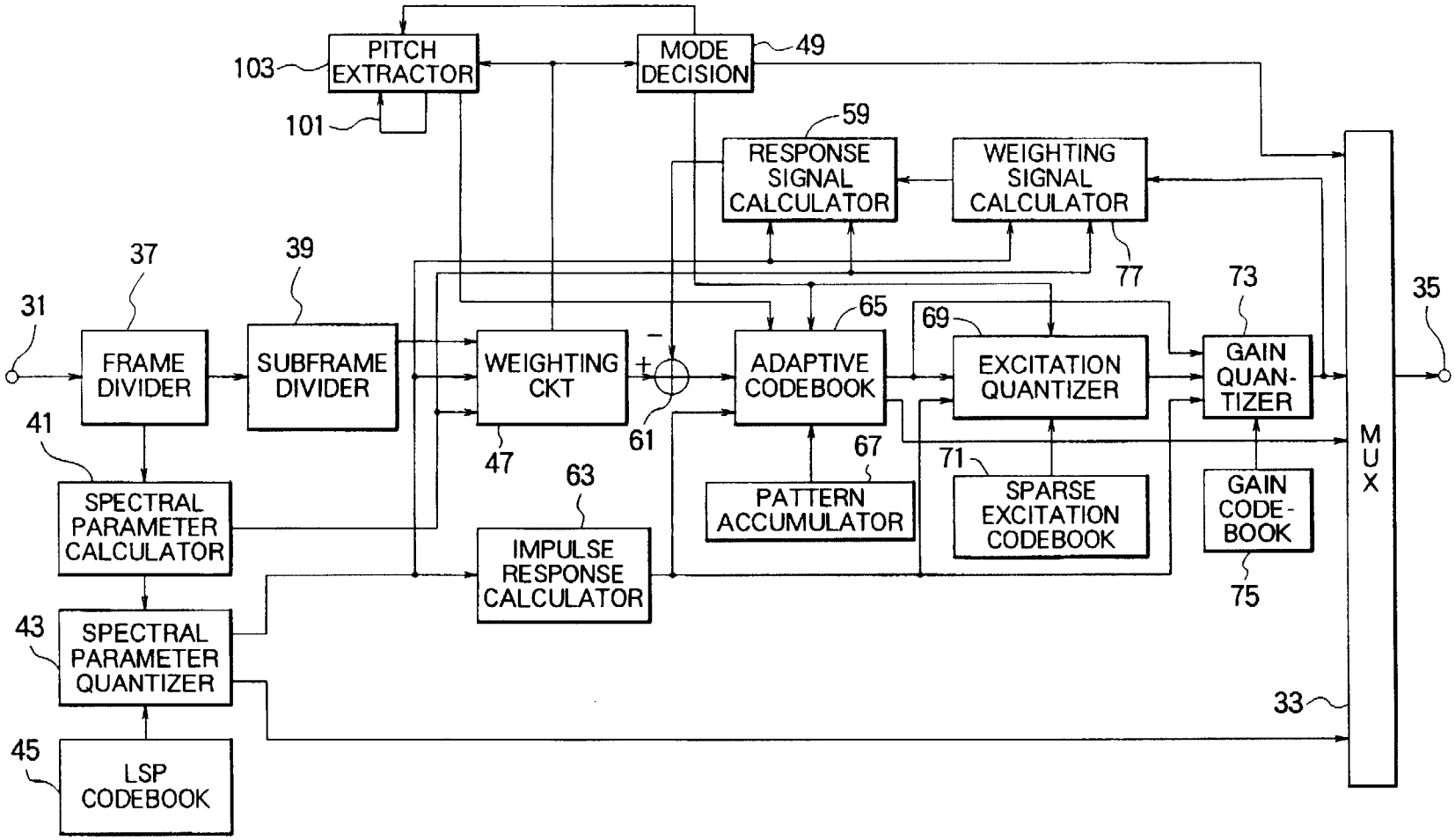
FIG. 16 is a block diagram of a speech signal encoder device according to a sixth embodiment of this invention.

Referring now to FIG. 16, attention will be directed to a speech signal encoder device according to a sixth preferred embodiment of this invention. In this speech signal encoder device, the mode decision circuit 49 is supplied only from the perceptual weighting circuit 47 with the weighted speech subframes at the frame period, calculates the pitch prediction gains as the feature quantities like the first feature quantity calculator 81 described in conjunction with FIG. 7, 8, 12, or 15, and decides the mode information of each original speech frame for delivery to the multiplexer 33, the adaptive codebook circuit 65, and the excitation quantizer 69. In the example being illustrated, the mode information is additionally used in the manner which will be described in the following.

Connected to the perceptual weighting circuit 47, supplied from the mode decision circuit 49 with the mode information at the frame period, and accompanied by a partial feedback loop 101, a pitch extracting circuit 103 calculates corrected pitches CPP in each frame period for supply to the adaptive codebook circuit 65 as follows.

Figure 17:
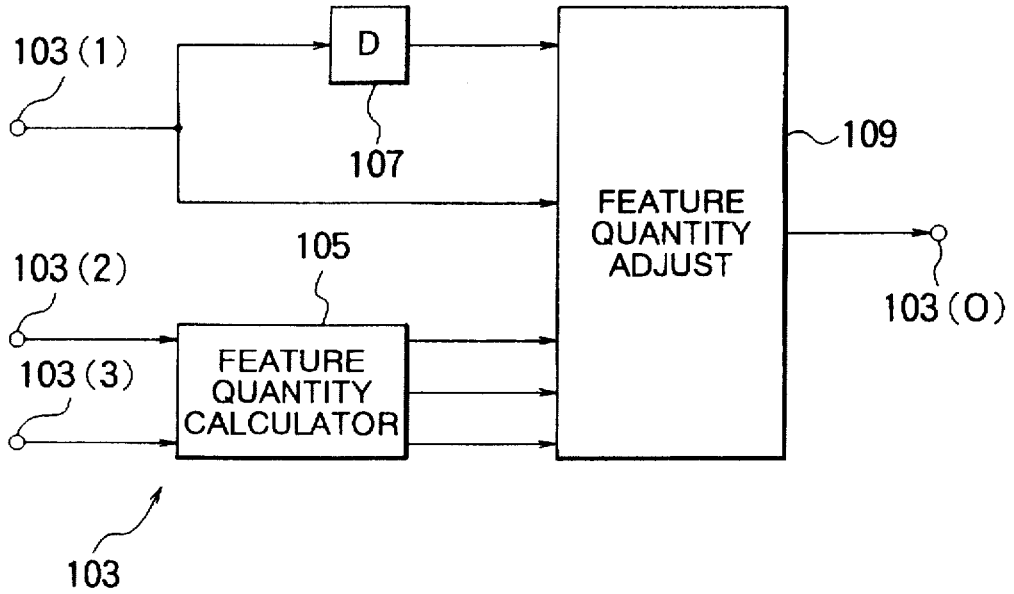
FIG. 17 is a block diagram of a pitch extracting circuit used in the speech signal encoder device illustrated in FIG. 16.

Turning to FIG. 17 with FIG. 16 continuously referred to, the pitch extracting circuit 103 has a first extracting circuit input terminal 103(1) connected to the mode decision circuit 49, a second extracting circuit input terminal 103(2) connected to the perceptual weighting circuit 47, and a third extracting circuit input terminal 103(3) connected to the partial feedback loop 101. An extracting circuit output terminal 103(O) is connected to the adaptive codebook circuit 65.

In the manner which will presently be described, the partial feedback loop 101 feeds a current pitch CP of each current frame to the third extracting circuit input terminal 103(3). An additional feature quantity calculator 105 calculates such current pitches, previous pitches PP, and pitch ratios DR in response to the current pitches and to the weighted speech subframes supplied thereto at the frame period. The previous pitches have a common delay of one frame period relative to the current pitches. Each pitch ratio represents a rate of variation in the current pitches in each frame period.

Connected to the first extracting circuit input terminal 103(1), a frame delay (D) 107 gives a delay of one frame period to produce delayed information. Supplied from the first extracting circuit input terminal 103(1) with the mode information, from the frame delay 107 with the delayed information, and from the additional feature quantity calculator 105 with the current pitches, the previous pitches, and the pitch ratios collectively as feature quantities, a feature quantity adjusting unit 109 compares the pitch ratios with a predetermined additional threshold value with reference to the mode and the delayed information to adjust or correct the current pitches by the previous pitches and the pitch ratios into adjusted pitches CPP for delivery to the extracting circuit output terminal 103(O).

Figure 18:
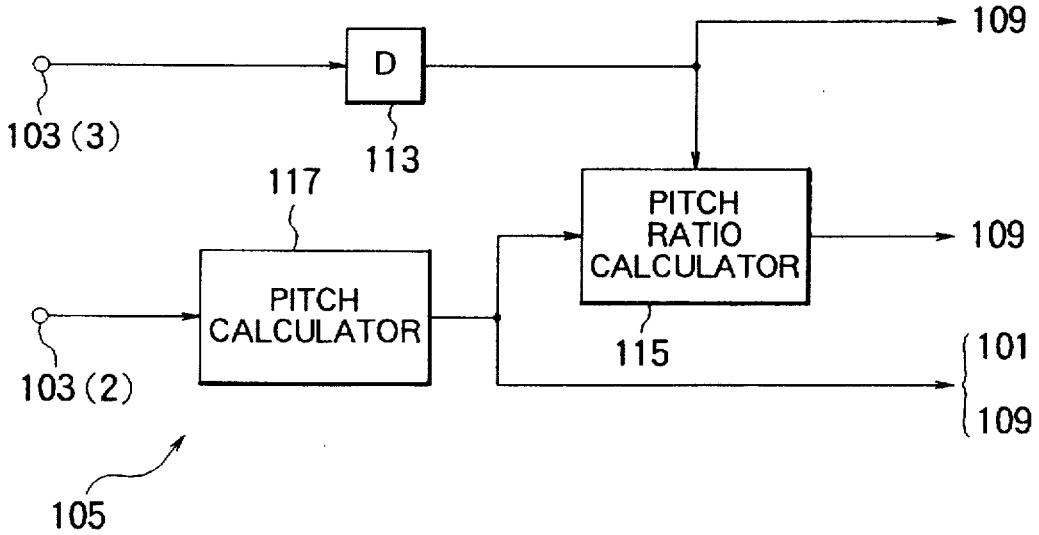
FIG. 18 shows in blocks an additional feature quantity calculator used in the pitch extracting circuit depicted in FIG. 17.

Further turning to FIG. 18 with FIGS. 16 and 17 continuously referred to, the additional feature quantity calculator 105 comprises a pitch calculator 111 connected to the first extracting circuit input terminal 103(2) to receive the perceptually weighted speech subframes at the frame period and to calculate the current pitches CP for delivery to the partial feedback loop 101 and to the feature quantity adjusting unit 109. Supplied with the current pitches through the second extracting circuit input terminal 103(2), a frame delay (D) 113 produces the previous pitches PP for supply to the feature quantity adjusting unit 109. Supplied with the current and the previous pitches, a pitch ratio calculator 115 calculates the pitch ratios DR for supply to the feature quantity adjusting unit 109.

In FIG. 16, the adaptive codebook circuit 65 is operable similar to that described in conjunction with the speech signal encoder device comprising the pitch calculator 79 illustrated with reference to FIG. 4. More specifically, the adaptive codebook circuit 65 closed-loop searches for the pitches in each previous subframe of the subframe difference signal near the adjusted pitches CPP rather than the lag parameters near the pitches calculated by the pitch calculator 79.

In other respects, the speech signal encoder device of FIG. 15 is similar to that illustrated with reference to FIG. 6.

Figure 19:
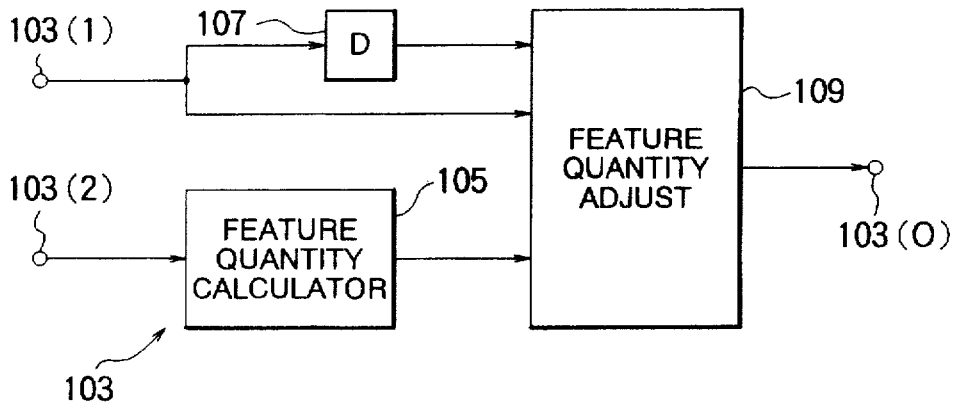
FIG. 19 is a block diagram of another pitch extracting circuit for use in the speech signal encoder device illustrated in FIG. 16.

Referring to FIG. 19 with FIG. 15 additionally referred to, another pitch extracting circuit is for use in the speech signal encoder device under consideration. This pitch extracting circuit corresponds to that illustrated with reference to FIG. 17 and will be designated by the reference numeral 103.

The pitch extracting circuit 103 has only the first and the second extracting circuit input terminals 103(1) and 103(2) and the extracting circuit output terminal 103(O). In other words, the pitch extracting circuit 103 is not accompanied by the partial feedback loop 101 described in connection with FIG. 16.

Supplied from the perceptual weighting circuit 47 with the weighted speech subframes frame by frame, the additional feature quantity calculator 105 calculates the current pitches CP as the feature quantities. Responsive to the mode information supplied from the mode decision circuit 49 frame by frame and to the delayed information produced by the frame delay 107, the feature quantity adjusting unit 109 adjusts the current pulses into the adjusted pitches CPP for use in the adaptive codebook circuit 65.

Figure 20:
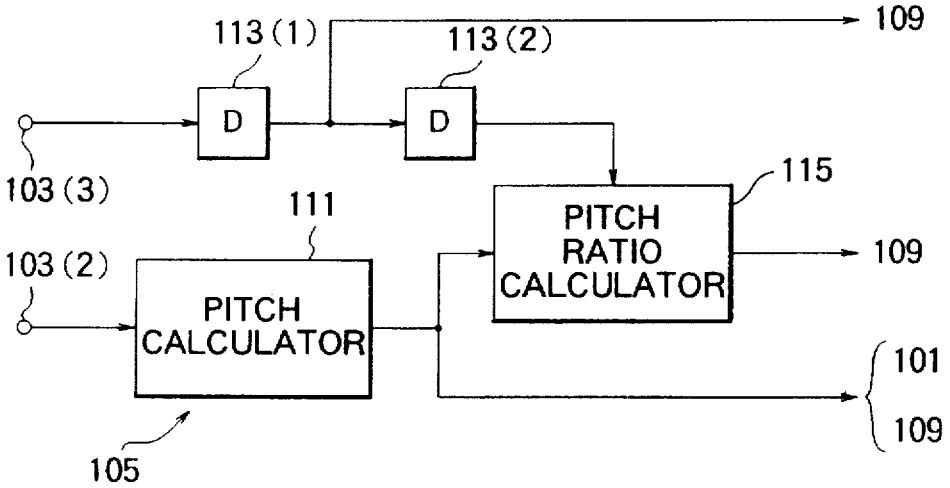
FIG. 20 shows in blocks another additional feature quantity calculator for use in the pitch extracting circuit depicted in FIG. 17.

Referring to FIG. 20 with FIGS. 16 and 17 additionally referred to, another additional feature quantity calculator is for use in the pitch extracting circuit 103 accompanied by the partial feedback loop 101 and is designated by the reference numeral 105. This additional feature quantity calculator 105 is similar to that illustrated with reference to FIG. 18. In the additional feature quantity calculator 105 being illustrated, the frame delay 113 of FIG. 18 is afresh referred to as a first frame delay 113(1) and delivers the previous pitches PD to the feature quantity adjusting unit 109.

Supplied through the second extracting circuit input terminal 103(2) with the perceptually weighted speech subframes at the frame period, the pitch calculator 111 calculates the current pitches CP for supply to the feature quantity calculating unit 109 and to the partial feedback loop 101 and thence to the third extracting circuit input terminal 103(3) depicted in FIG. 18. Connected in series to the first frame delay 113(1), a second delay 113(2) gives a delay of one frame period to the previous pitches to produce past previous pitches PPP which have a long delay of two frame periods relative to the current pitches. So as to deliver the pitch ratios DR to the feature quantity adjusting unit 109, the pitch ratio calculator 115 is operable identically with that described in connection with FIG. 18.

Figure 21:
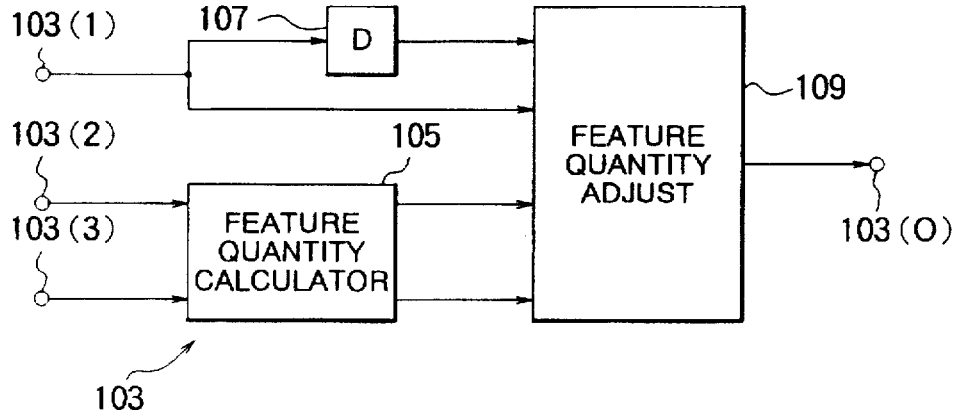
FIG. 21 is a block diagram of still another pitch extracting circuit for use in the speech signal encoder device illustrated in FIG. 16.

Referring to FIG. 21 with FIG. 16 continuously referred to, the pitch extracting circuit 103 is for use in combination with the partial feedback loop 101. Supplied with the mode information frame by frame through the first extracting circuit input terminal 103(1), with the perceptually weighted speech subframes frame by frame through the second extracting circuit input terminal 103(2), and with the current pitches CC through the third extracting circuit input terminal 103(3), this pitch extracting circuit 103 delivers the adjusted pitches CPP to the adaptive codebook circuit 65 through the extracting circuit output terminal 103(O).

Connected to the second and the third extracting circuit input terminals 103(2) and 103(3), an additional feature quantity calculator is similar to that described with reference to any one of FIGS. 17 through 20 and is consequently designated again by the reference numeral 105. Responsive to the perceptually weighted speech subframes of each frame and to the current pitches, this additional feature quantity calculator 105 calculates the pitch ratios DR for delivery together with the current pitches to the feature quantity adjusting unit 109 collectively as the feature quantities. Responsive to the mode and the delayed information, the feature quantity adjusting unit 107 compares the pitch ratios with the additional threshold value to adjust the current pitches now only by the pitch ratios into the adjusted pitches.

Figure 22:
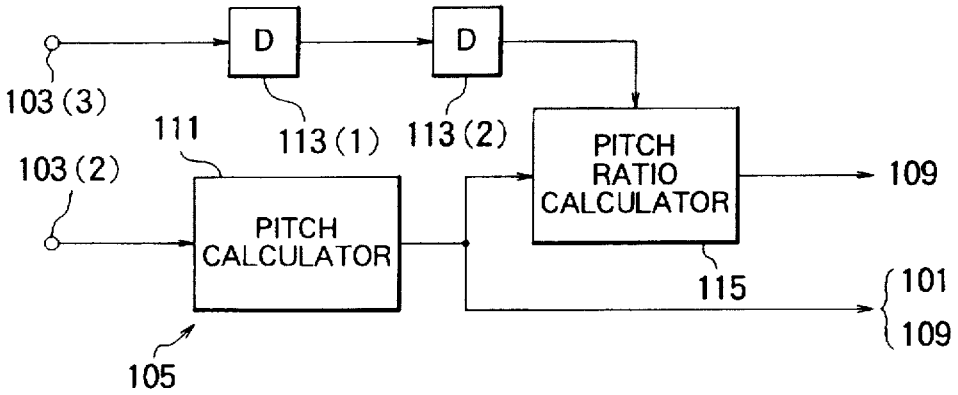
FIG. 22 shows in blocks an additional feature quantity calculator used in the pitch extracting circuit depicted in FIG. 21.

Turning to FIG. 22 with FIGS. 16 and 21 continuously referred to, the additional feature quantity calculator 105 is similar to that illustrated with reference to FIGS. 18 or 20. The previous pitches are, however, not supplied to the feature quantity adjusting unit 109.

Referring again to FIG. 22 with FIGS. 16 and 21 additionally referred to, the additional feature calculator 105 may comprise, instead of the first and the second frame delays 113(1) and 113(2), singly the frame delay 113 between the third extracting circuit input terminal 103(3) and the pitch ratio calculator 115 as in FIG. 18 and without supply of the previous pitches to the feature quantity adjusting unit 109.

Figure 23:
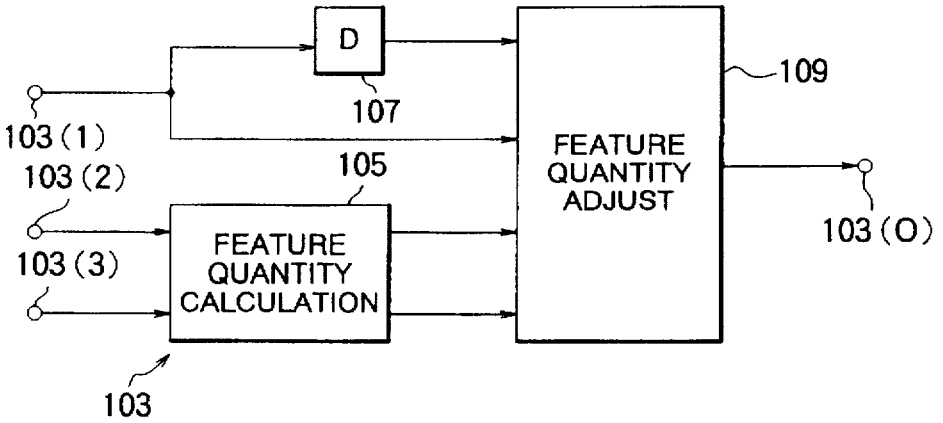
FIG. 23 is a block diagram of yet another pitch extracting circuit for use in the speech signal encoder device illustrated in FIG. 16.

Referring anew to FIG. 23 with FIG. 16 continuously referred to, the pitch extracting circuit 103 is not different from that of FIG. 21 insofar as depicted in blocks. The additional feature quantity calculator 105 is, however, a little different from that described in conjunction with FIG. 21. Accordingly, the feature quantity adjusting unit 109 is somewhat differently operable.

Figure 24:
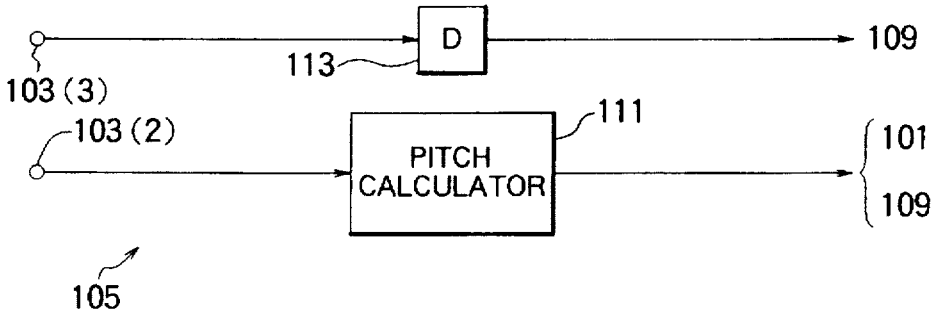
FIG. 24 shows in blocks an additional feature quantity calculator used in the pitch extracting circuit depicted in FIG. 23.

Turning to FIG. 24 with FIGS. 16 and 23 continuously referred to, the additional feature quantity calculator 105 comprises the pitch calculator 111 supplied through the second extracting circuit input terminal 103(2) with the perceptually weighted speech subframes at the frame period to deliver the current pitches CC to the partial feedback loop 101 and to the feature quantity adjusting unit 109. The frame delay 113 is supplied with the current pitches CP through the third extracting circuit input terminal 103(3) to supply the previous pitches PP to the feature quantity adjusting unit 109.

Turning back to FIG. 23, the feature quantity adjusting unit 109 is operable as follows. In response to the mode and the delayed information supplied through the first extracting circuit input terminal 103(1) directly and additionally through the frame delay 107, the feature quantity adjusting unit 109 compares the previous pitches with predetermined further additional threshold values to adjust the current pitches by the previous pitches into the adjusted pitches CPP.

Figure 25:
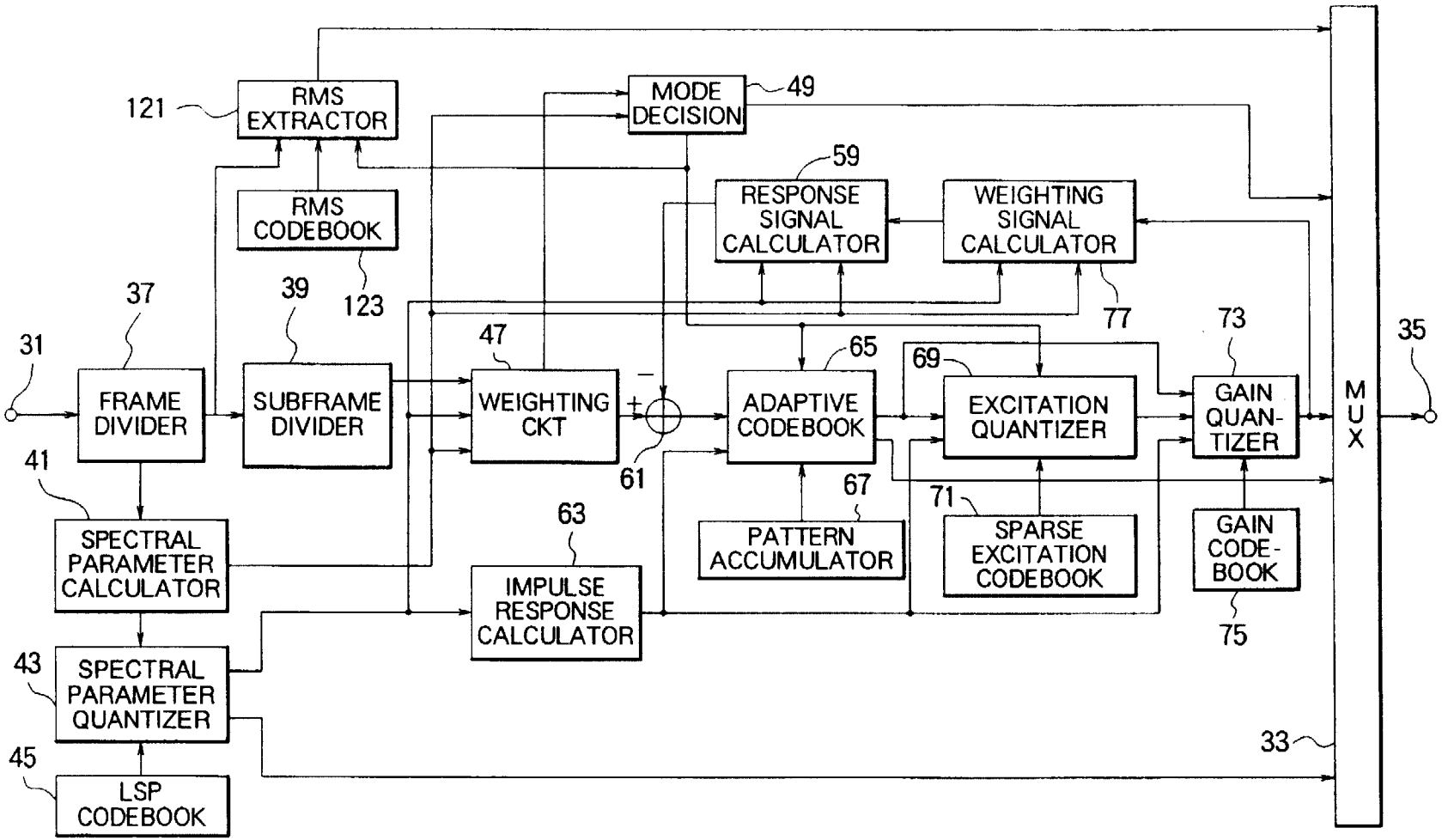
FIG. 25 is a block diagram of a speech signal encoder device according to a seventh embodiment of this invention.

Referring afresh to FIG. 25, the description will proceed to a speech signal encoder device according to a seventh preferred embodiment of this invention. This speech signal encoder device is different as follows from that illustrated with reference to FIG. 5.

In the manner described referring to FIGS. 6 and 7, 8, 12, or 15, the mode decision circuit 49 calculates the pitch prediction gains at the frame period and decides the mode information. In the manner described in the Ozawa et al paper, an RMS extracting circuit 121 is connected to the frame dividing circuit 37 and is accompanied by an RMS codebook 123 keeping a plurality of RMS code vectors. Controlled by the mode information specifying one of the predetermined modes for each of the original speech frames into which the input speech signal is segmented, the RMS extracting circuit 121 selects one of the RMS code vectors as a selected RMS vector for delivery to the multiplexer 33 and therefrom to the device output terminal 35. The RMS extracting circuit 121 serves as a level extracting arrangement.

Figure 26:
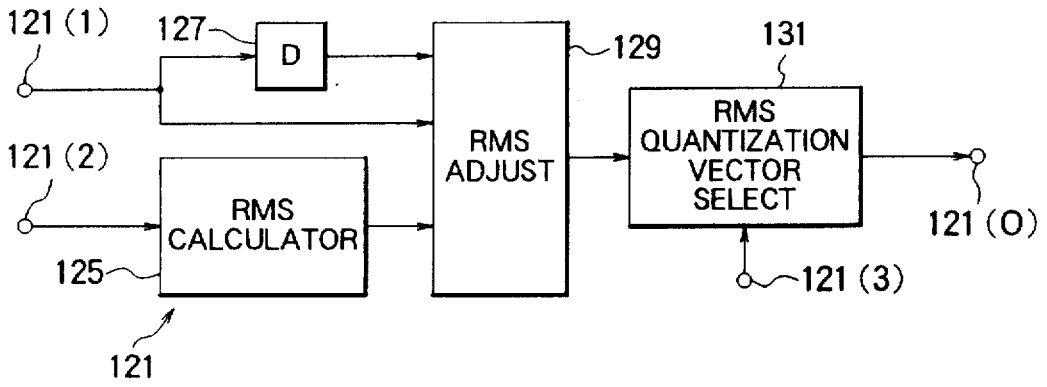
FIG. 26 is a block diagram of an RMS extracting circuit used in the speech signal encoder device illustrated in FIG. 25.

Turning to FIG. 26 with FIG. 25 continuously referred to, the RMS extracting circuit 121 has a first extracting circuit input terminal 121(1) supplied from the mode decision circuit 49 with the mode information as current mode information at the frame period. Connected to the frame dividing circuit 37, a second extracting circuit input terminal 121(2) is supplied with the original speech frames. A third extracting circuit 121(3) is for referring to the RMS codebook 123. An extracting circuit output terminal 123(O) is for delivering the selected RMS vector to the multiplexer 33.

Figure 14:
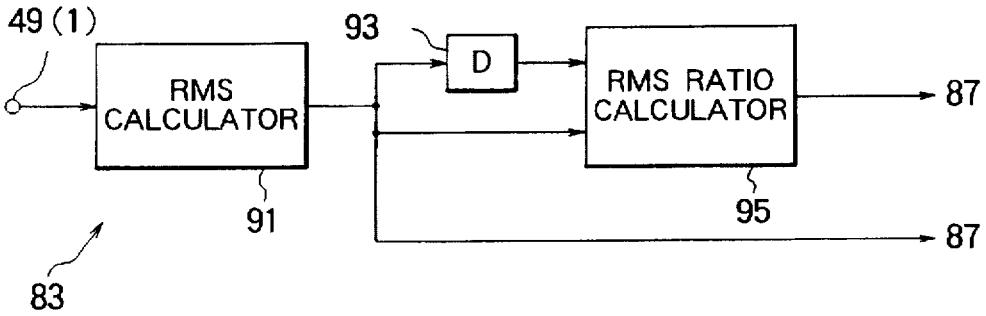
FIG. 14 shows in blocks a different feature quantity calculator for use in place of the feature quantity calculator illustrated in FIG. 12.

Connected to the second extracting circuit input terminal 121(2), an RMS calculator 125 calculates the RMS values R like the RMS calculator 91 described in conjunction with FIG. 9, 13, or 14. Responsive to the current mode information and to previous mode information supplied from the first extracting circuit input terminal 121(1) directly and through a frame delay (D) 127, an RMS adjusting unit 129 compares the RMS values fed from the RMS calculator 125 as original RMS values with a predetermined still further additional threshold value to adjust the original RMS values into adjusted RMS values IR. Connected to the RMS adjusting unit 129 and to the third extracting circuit input terminal 121(3), an RMS quantization vector selector 131 selects one of the RMS code vectors that is most similar to the adjusted RMS values at each frame period as the selected RMS vector for delivery to the extracting circuit output terminal 121(O).

Figure 27:
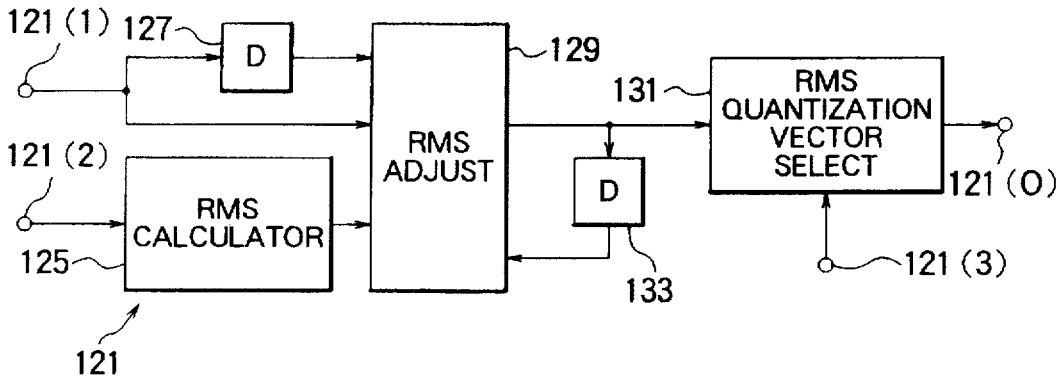
FIG. 27 is a block diagram of another RMS extracting circuit for use in the speech signal encoder device illustrated in FIG. 25.

Further turning to FIG. 27 with FIG. 25 continuously referred to, the RMS extracting circuit 121 additionally comprises an additional frame delay 133 supplied from the RMS adjusting unit 129 with the adjusted RMS values as current adjusted values to supply previous adjusted values back to the RMS adjusting unit 129. Responsive to the current and the previous mode information and to the previous adjusted values, the RMS adjusting unit 129 adjusts the original RMS values into the adjusted RMS values.

Still further turning to FIG. 28 with FIG. 25 continuously referred to, the RMS extracting circuit 121 is different from that illustrated with reference to FIG. 27 in that the previous adjusted values are not fed back to the RMS adjusting unit 129. Instead, the additional frame delay 133 delivers the previous adjusted values to an RMS ratio calculator 135 which is supplied from the RMS calculator 125 with the original RMS values to calculate RMS ratios RR for feed back to the RMS adjusting unit 129. In connection with the RMS ratios, it should be noted that the previous adjusted values are produced by the additional frame delay 133 concurrently with previous RMS values which are the original RMS values delivered one frame period earlier from the RMS calculator 125 to the RMS adjusting unit 129 than the previous adjusted values under consideration. Each RMS ratio is a ratio of each original RMS value to one of the previous adjusted values that is produced by the additional frame delay 133 concurrently with the previous RMS value one frame period earlier than the abovementioned each original RMS value.

The RMS adjusting unit 129 is now operable like the feature quantity adjusting unit 109 described by again referring to FIG. 22. More in detail, the RMS adjusting unit 129 produces the RMS adjusted values IR by comparing the original RMS values R with the still further additional threshold value in response to the current and the previous mode information and the RMS ratios.

Figure 29:
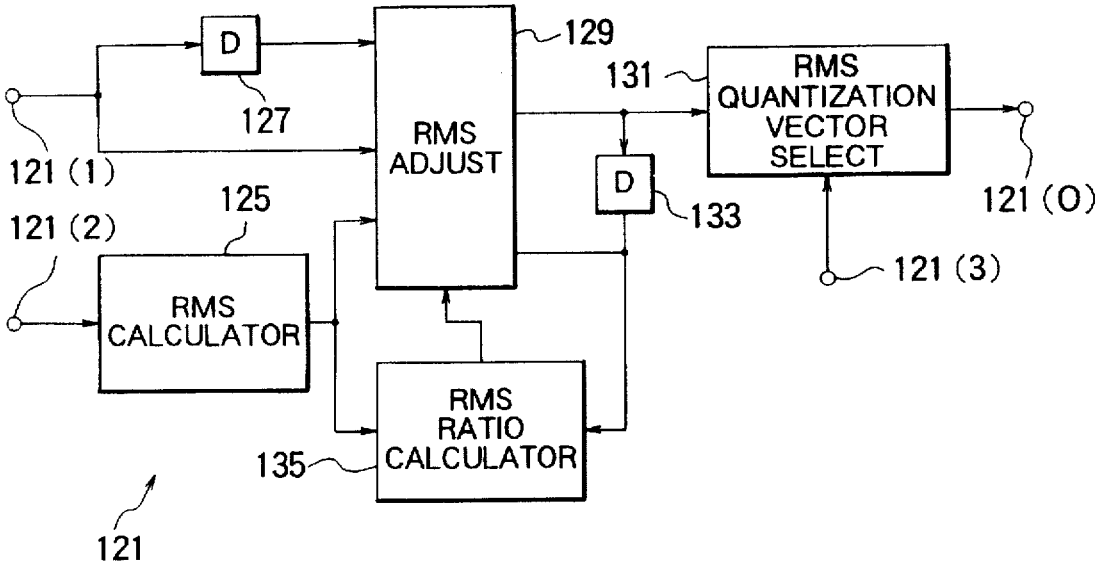
FIG. 29 is a block diagram of yet another RMS extracting circuit for use in the speech signal encoder device illustrated in FIG. 25.

Referring to FIG. 29 with FIG. 25 continuously referred to, the RMS extracting circuit 121 comprises the RMS adjusting unit 129 which is additionally supplied from the additional frame delay 133 with the previous adjusted values besides the original RMS values and the RMS ratios. The RMS adjusting unit 129 is consequently operable like the feature quantity adjusting unit 109 described in conjunction with FIGS. 17 and 18. More particularly, the RMS adjusting unit 129 produces the RMS adjusted values IR by comparing the original RMS values with the still further additional threshold value to adjust the current RMS values by the previous adjusted values in response to the current and the previous mode information and the RMS ratios.

Figure 28:
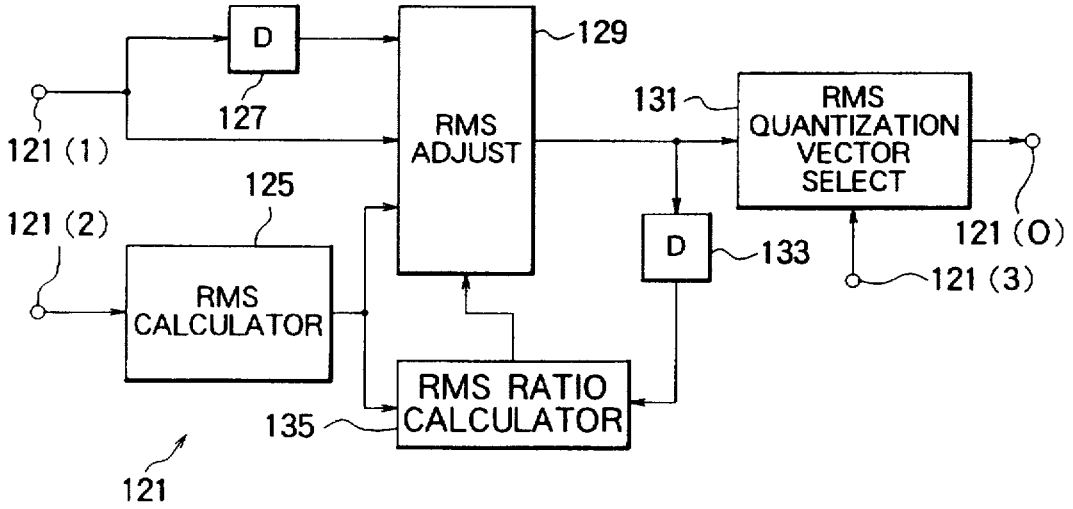
FIG. 28 is a block diagram of still another RMS extracting circuit for use in the speech signal encoder device illustrated in FIG. 25.
Figure 30:
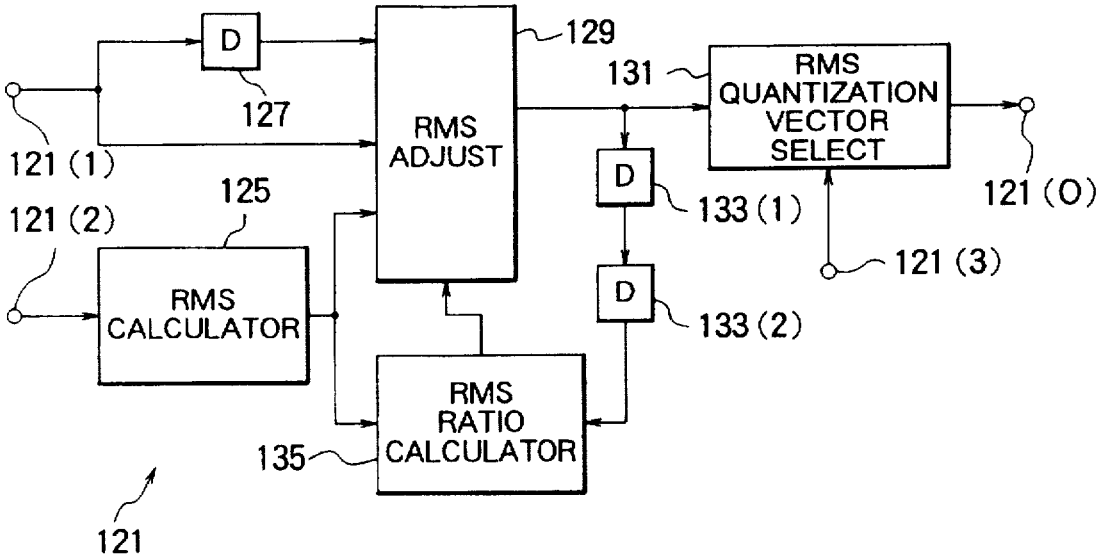
FIG. 30 is a block diagram of a further RMS extracting circuit for use in the speech signal encoder device illustrated in FIG. 25.

Turning to FIG. 30 with FIG. 25 continuously referred to, the RMS extracting circuit 121 is different from that illustrated with reference to FIG. 28 in that the additional frame delay 133 of FIG. 28 is changed to a series connection of first and second frame delays 133(1) and 133(2). The RMS ratio calculator 135 calculates RMS ratios of the current RMS values to past previous RMS adjusted values produced by the RMS adjusting unit 129 in response to RMS values which are two frame periods prior to the current RMS values. The RMS adjusting unit 129 is operable in the manner described as regards the RMS extracting circuit 121 illustrated with reference to FIG. 28. It should be noted in this connection that the RMS ratios are different between the RMS adjusting units described in conjunction with FIGS. 28 and 30.

Referring once more to FIGS. 29 and 30 with FIG. 25 continuously referred to, the RMS extracting circuit 121 may comprise the first and the second additional frame delays 133(1) and 133(2) and a signal line between the first additional frame delay 133(1) and the RMS adjusting unit 129 in the manner depicted in FIG. 29. The RMS ratio calculator 135 is operable as described in connection with FIG. 30. The RMS adjusting unit 129 is, operable as described in conjunction with FIG. 29.

What is claimed is:

1. A speech signal encoder device comprising:

segmenting means for segmenting an input speech signal into original speech frames at a predetermined frame period;

deciding means for using said original speech frames in deciding a predetermined number of modes of said original speech frames to produce decided mode results;

weighting means for perceptually weighting said original speech frames into weighted speech frames; and encoding means for encoding said input speech signal into codes at said frame period and in response to said modes to produce said decided mode results and said codes as an encoder device output signal, wherein said deciding means makes use, in deciding a current mode of said modes for each current speech frame segmented from said input speech signal at said frame period, of feature quantities of at least one kind extracted from said current speech frame and a previous speech frame segmented at least one frame period prior to said current speech frame and of a previous mode decided at least one frame period prior to said current mode.

wherein said deciding means uses said weighted speech frames in deciding said modes, wherein said feature quantities are rates of variation with time in said feature quantities, said speech signal encoder device further comprising:

means for extracting each of primary quantities of said feature quantities from said current speech frame, wherein said deciding means comprises:

means for extracting said rates of variation from said current and said previous speech frames as secondary quantities of said feature quantities; and mode deciding means for deciding said current mode in response to said primary and said secondary quantities and said previous mode.

2. A speech signal encoder device as claimed in claim 1, wherein:

said mode deciding means adjusts said current mode into an adjusted mode in response to said primary and said secondary quantities and said previous mode;

said encoding means using, as said modes, adjusted modes produced by said mode deciding means for said input speech signal.

3. A speech signal encoder device comprising segmenting means for segmenting an input speech signal into original speech frames at a predetermined frame period, deciding means for using said original speech frames in deciding a predetermined number of modes of said original speech frames to produce decided mode results, extracting means for extracting pitches from said input speech signal, and encoding means for encoding said input speech signal into codes at said frame period and in response to said modes to produce said decided mode results and said codes as an encoder device output signal, wherein:

said extracting means comprises:

feature quantity extracting means for extracting feature quantities by using at least each current speech frame segmented from said input speech signal at said frame period; and feature quantity adjusting means for using said feature quantities as said pitches to adjust said pitches into adjusted pitches in response to each current mode decided for said current speech frame and a previous mode decided at least one frame period prior to said current mode;

said encoding means encoding said input speech signal into said codes in response further to said adjusted pitches.

4. A speech signal encoder device as claimed in claim 3, further comprising weighting means for perceptually weighting said original speech frames into weighted speech frames, wherein said deciding means uses said weighted speech frames in deciding said modes.

5. A speech signal encoder device as claimed in claim 3, wherein said feature quantity extracting means extracts said pitches in response to said current speech frame and rates of variation with time in said pitches in response to said current speech frame and a previous speech frame segmented at least one frame period prior to said current speech frame.

6. A speech signal encoder device as claimed in claim 3, wherein each of said feature quantities is one of a pitch prediction gain, a short-period predicted gain, a level, and a pitch of said current speech frame.

7. A speech signal encoder device comprising segmenting means for segmenting an input speech signal into original speech frames at a predetermined frame period, deciding means for using said original speech frames in deciding a predetermined number of modes of said original speech frames to produce decided mode results, extracting means for extracting levels from said input speech signal, and encoding means for encoding said input speech signal into codes at said frame period and in response to said modes to produce said decided mode results and said codes as an encoder device output signal, wherein:

said extracting means comprises:

feature quantity extracting means for extracting feature quantities by using at least each current speech frame segmented from said input speech signal at said frame period; and feature quantity adjusting means for using said feature quantities as said levels to adjust said levels into adjusted levels in response to each current mode decided for said current speech frame and a previous mode decided at least one frame period prior to said current mode;

said encoding means encoding said input speech signal into said codes in response further to said adjusted levels.

8. A speech signal encoder device as claimed in claim 7, further comprising weighting means for perceptually weighting said original speech frames into weighted speech frames, wherein said deciding means uses said weighted speech frames in deciding said modes.

9. A speech signal encoder device as claimed in claim 8, wherein said feature quantity extracting means extracts said levels in response to said current speech frame and rates of variation with time in said levels in response to said current speech frame and a previous speech frame segmented at least one frame period prior to said current speech frame.

10. A speech signal encoder device as claimed in claim 9, wherein each of said feature quantities is one of a pitch prediction gain, a short-period predicted gain, a level, and a pitch of said current speech frame.

* * * * *